US012295466B2

(12) United States Patent
Nelson et al.

(10) Patent No.: US 12,295,466 B2
(45) **Date of Patent: *May 13, 2025**

(54) JEWELRY DEVICE

(71) Applicant: Be Sunny Gifts, LLC, Milford, OH (US)

(72) Inventors: Tammy Rae Nelson, Mason, OH (US); Jake Matthew Nelson, Mason, OH (US)

(73) Assignee: Be Sunny Gifts, LLC, Mason, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/609,848

(22) Filed: Mar. 19, 2024

(65) Prior Publication Data

US 2024/0215692 A1 Jul. 4, 2024

Related U.S. Application Data

(63) Continuation of application No. 18/094,129, filed on Jan. 6, 2023, now Pat. No. 12,035,788, which is a continuation of application No. 17/379,061, filed on Jul. 19, 2021, now Pat. No. 11,571,049, which is a continuation of application No. 16/694,533, filed on Nov. 25, 2019, now Pat. No. 11,064,775.

(60) Provisional application No. 62/771,406, filed on Nov. 26, 2018.

(51) Int. Cl.
*A44C 9/00* (2006.01)

(52) U.S. Cl.
CPC ..... *A44C 9/0053* (2013.01)

(58) Field of Classification Search
CPC ..... A44C 9/02; A44C 25/00; A44C 25/001; A44C 25/007; A44C 17/0258; A44C 9/00; A44C 9/0053; A44C 15/0025; A44C 15/004; A44C 15/00; A44C 15/0015
See application file for complete search history.

(56) References Cited

U.S. PATENT DOCUMENTS 3,959,989 A * 6/1976 Bhandia ..... A44C 17/0258 446/244
5,588,310 A * 12/1996 Lai ..... A44C 9/00 63/29.1
2011/0179824 A1* 7/2011 Avneri-Katzir .... A44C 17/0225 63/15
2018/0228256 A1* 8/2018 Dekwiatkowski ... A44C 25/007

* cited by examiner

*Primary Examiner* — Jack W Lavinder
(74) *Attorney, Agent, or Firm* — Frost Brown Todd LLP; Vance V. VanDrake, III; Alexander J. Johnson

(57) ABSTRACT

A jewelry apparatus comprising a base member and a coupling member operably configured for attachment to the base member. The base member having a first prong and a second prong each having a first portion having a first width and a second portion having a second width smaller than the first width. The coupling member comprising a disk member having a first and second side, the first side having a first set of indicia and the second side having a second set of indicia; a first projection extending from the disk member operably configured for attachment to the first prong; and a second projection extending from the disk member operably configured for attachment to the second prong. The disk member is movably coupled to the base member and the coupling member is configured to rotate such that the indicia sets create the visual appearance of both the indicia sets.

14 Claims, 23 Drawing Sheets

JEWELRY DEVICE

CROSS-REFERENCE TO RELATED APPLICATIONS

This application is a continuation application of U.S. patent application Ser. No. 18/094,129, filed Jan. 6, 2023, which is continuation application of U.S. patent application Ser. No. 17/379,061, filed Jul. 19, 2021, now granted as U.S. Pat. No. 11,571,049, which is a continuation application of U.S. patent application Ser. No. 16/694,533, filed Nov. 25, 2019, now granted as U.S. Pat. No. 11,064,775, which claims the priority benefit of U.S. Provisional Patent Application No. 62/771,406, filed Nov. 26, 2018, the disclosures of which are incorporated herein in their entirety.

TECHNICAL FIELD

Embodiments of the technology relate to jewelry, including rings.

BACKGROUND

Often people need encouragement to overcome negative thoughts and emotions. Likewise, often people need inspiration to gain empowerment to overcome negative thoughts and emotions.

Daily stresses can be minimized if one starts his or her day off with right thinking. Starting off well can include being given an inspiring word or quote. Throughout the day a person can continue to be inspired and encouraged by continuing to be reminded of inspiring thoughts. People are more likely to take advantage of inspiration-providing opportunities if doing so can be entertaining, soothing, and/or relaxing.

Accordingly, there remains an unmet need for a device that can offer encouragement to a user in need of encouragement.

Further, there remains an unmet need for a wearable device that can provide inspiration to a user in need of inspiration.

Additionally, there remains an unmet need for a wearable device, system, and method that can deliver encouragement or inspiration in an entertaining and stylish manner.

SUMMARY

A jewelry apparatus is disclosed. The apparatus can include a base member having a hippocrepiform configuration, the base member having a first prong and a second prong. The jewelry apparatus can include a coupling member operably configured for attachment to the base member. The coupling member can include a disk member having a first side and a second side, the first side having a first set of indicia depicting a first partial portion of a word, the second side having a second set of indicia depicting a second partial portion of the word, a first projection extending from the disk member operably configured for attachment to the first prong and a second projection extending from the disk member operably configured for attachment to the second prong. The disk member is movably coupled to the base member, and the coupling member is configured to rotate such that the first set of indicia and the second set of indicia create the visual appearance of the word.

BRIEF DESCRIPTION OF THE DRAWINGS

The present disclosure will be more readily understood from a detailed description of some example embodiments taken in conjunction with the following figures.

DETAILED DESCRIPTION

Figure 1:
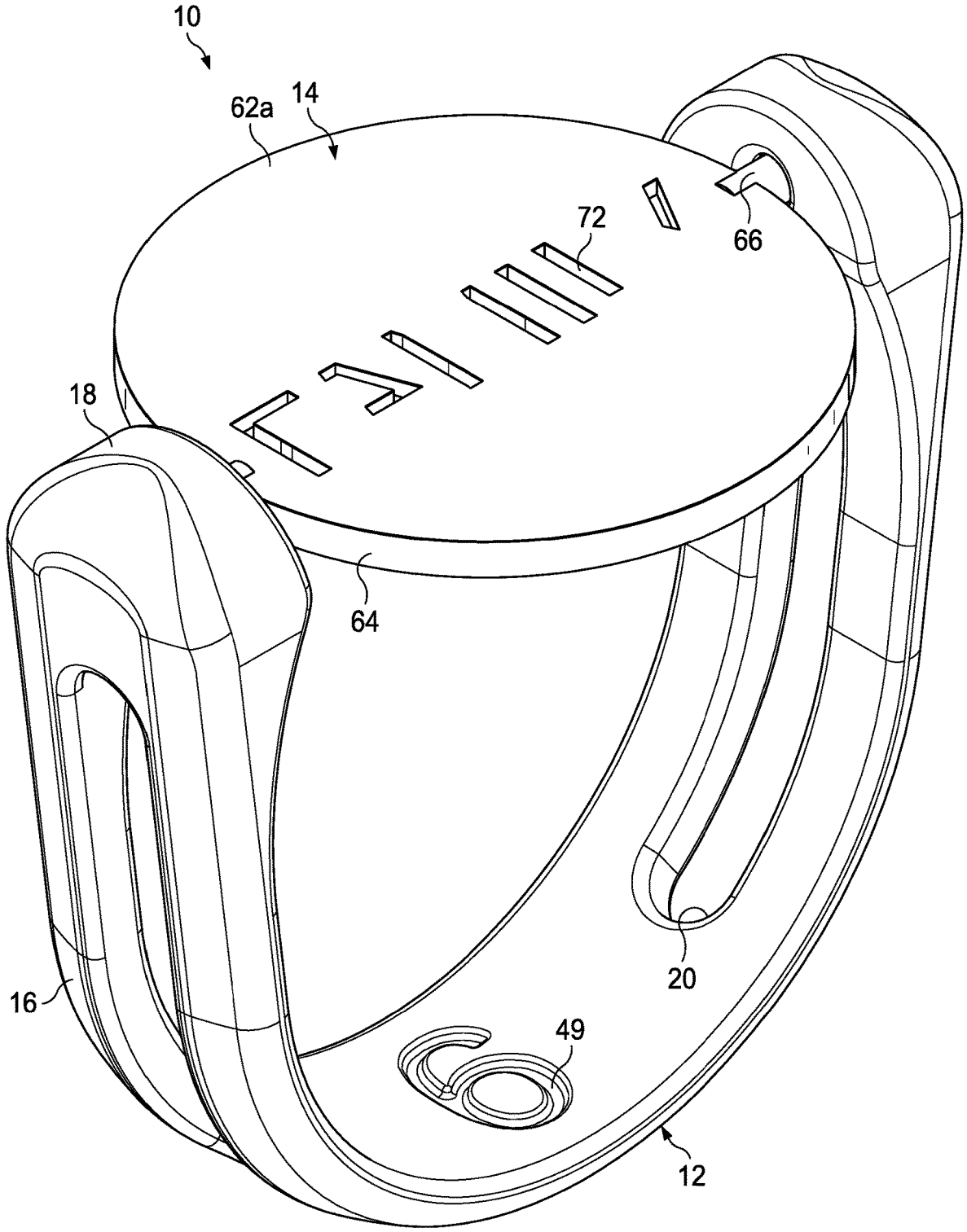
FIG. 1 depicts a perspective view of a jewelry device according to an embodiment.
Figure 2:
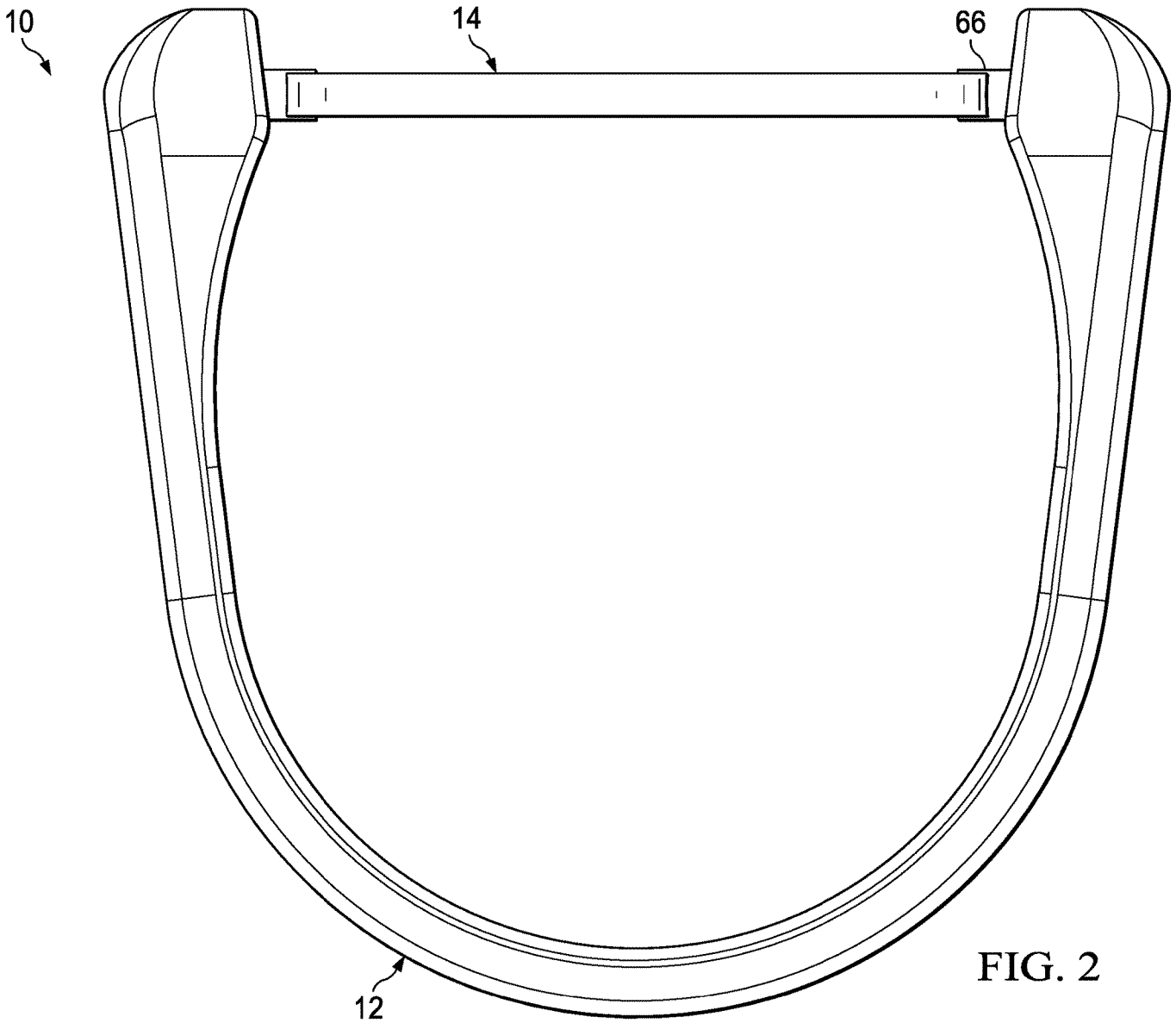
FIG. 2 depicts a front elevation view of the jewelry device of FIG. 1.
Figure 3:
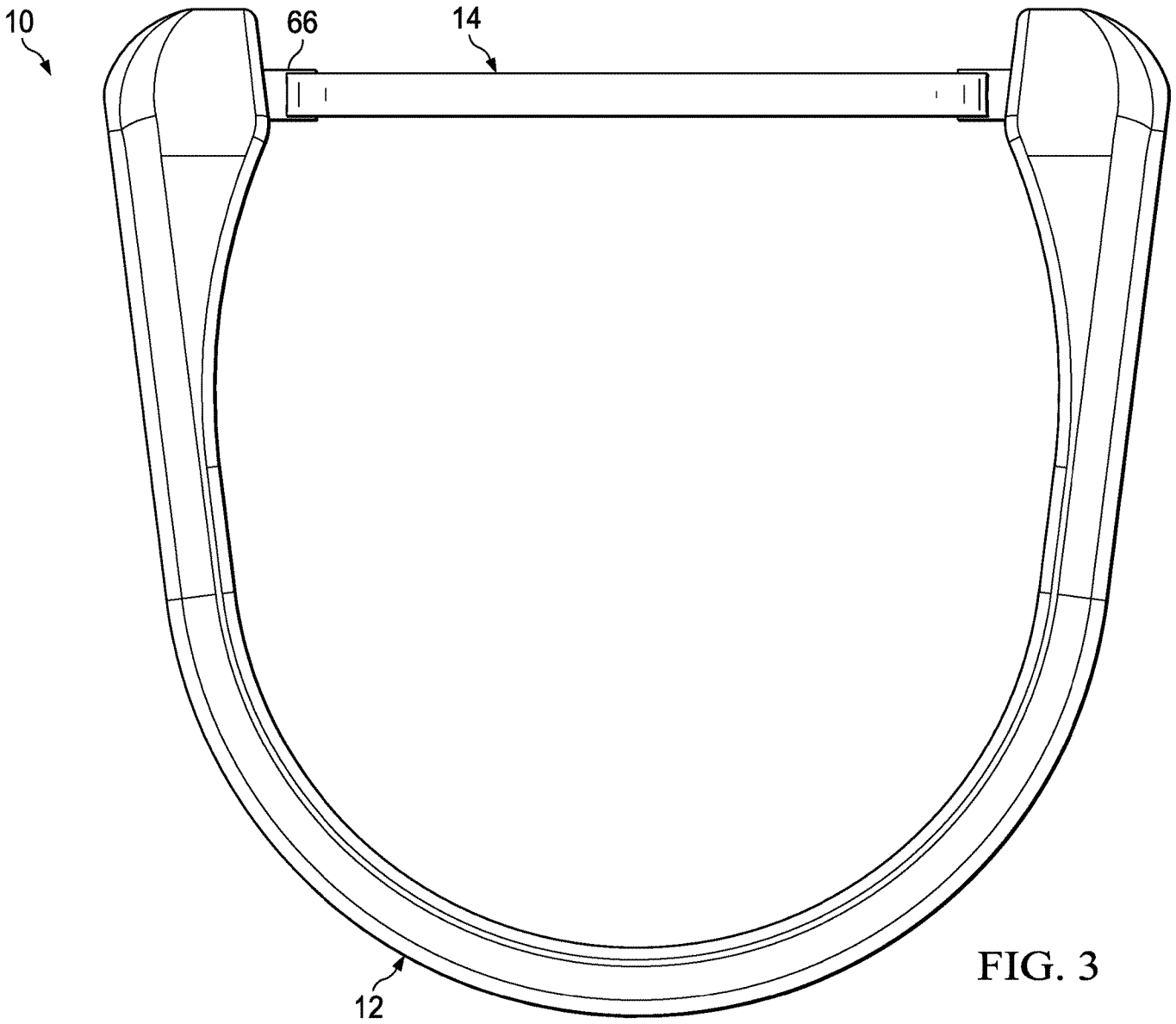
FIG. 3 depicts a rear elevation view of the jewelry device of FIG. 1.
Figure 4:
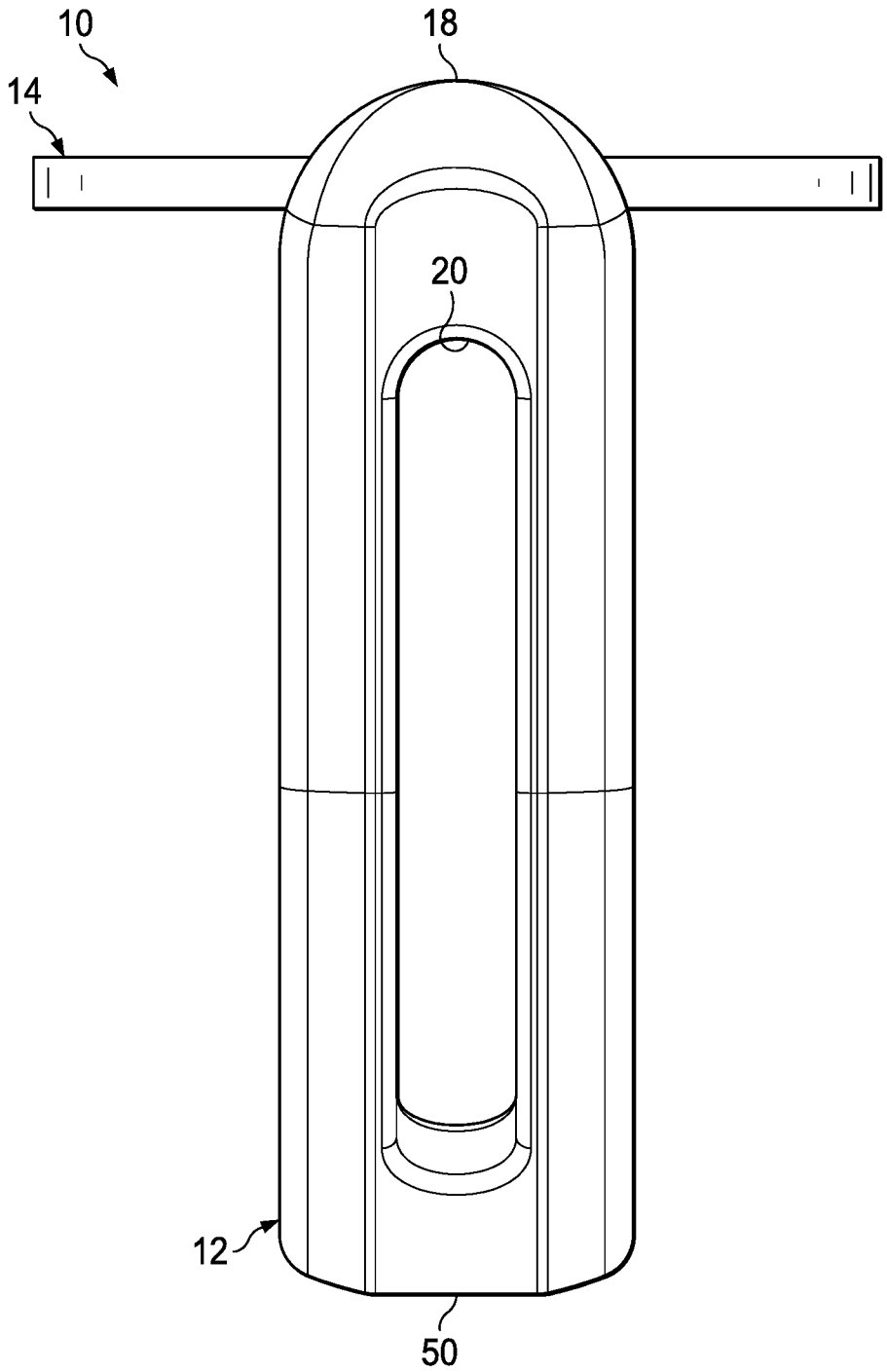
FIG. 4 depicts a right-side elevation view of the jewelry device of FIG. 1.
Figure 5:
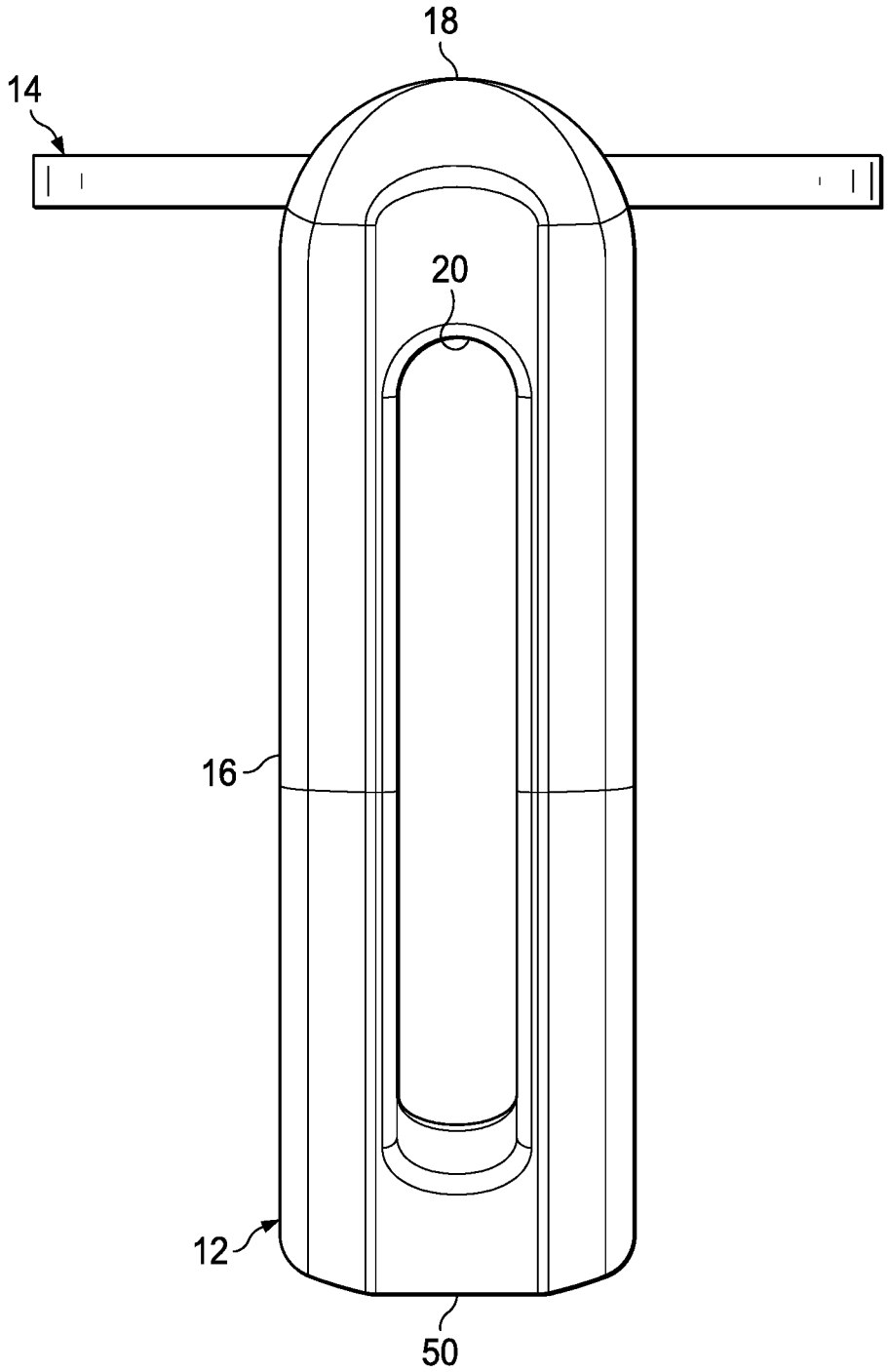
FIG. 5 depicts a left side elevation view of the jewelry device of FIG. 1.
Figure 6:
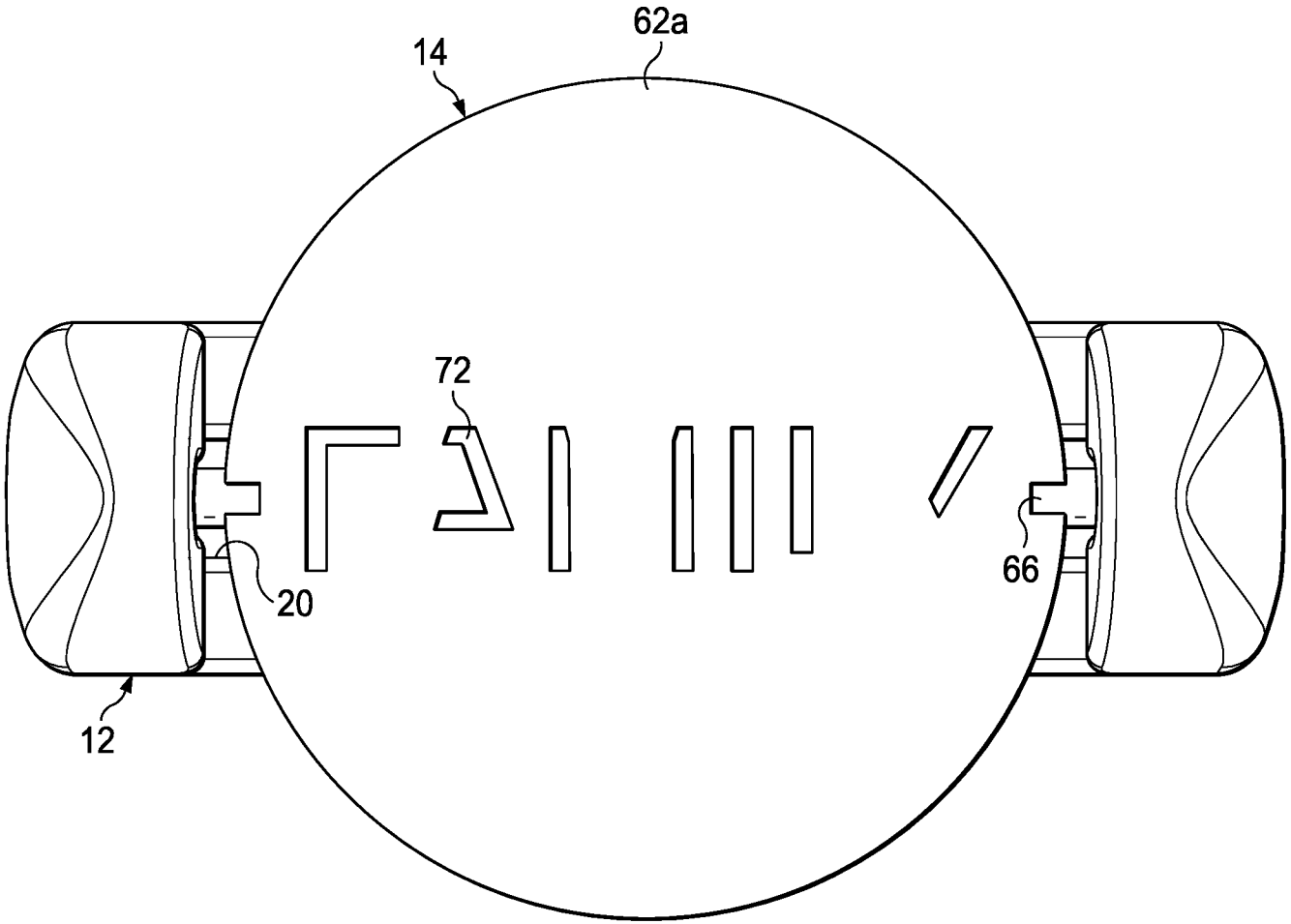
FIG. 6 depicts a top view of the jewelry device of FIG. 1.
Figure 7:
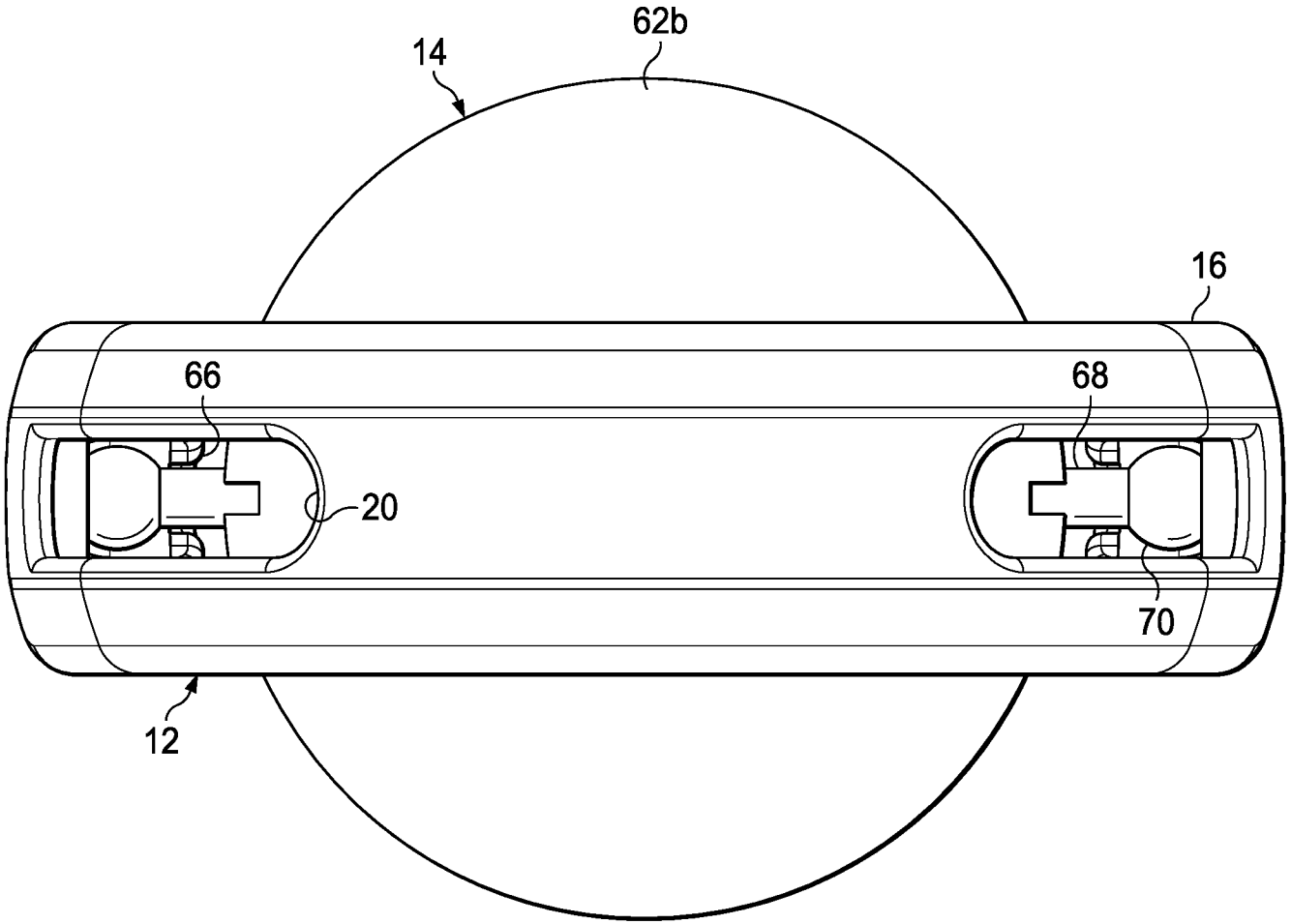
FIG. 7 depicts a bottom view of the jewelry device of FIG. 1.

Various non-limiting embodiments of the present disclosure will now be described to provide an overall understanding of the principles of the structure, function, and use of the apparatuses, systems, methods, and processes disclosed herein. One or more examples of these non-limiting embodiments are illustrated in the accompanying drawings. Those of ordinary skill in the art will understand that systems and methods specifically described herein and illustrated in the accompanying drawings are non-limiting embodiments. The features illustrated or described in connection with one non-limiting embodiment may be combined with the features of other non-limiting embodiments. Such modifications and variations are intended to be included within the scope of the present disclosure.

Reference throughout the specification to "various embodiments," "some embodiments," "one embodiment," "some example embodiments," "one example embodiment," or "an embodiment" means that a particular feature, structure, or characteristic described in connection with any embodiment is included in at least one embodiment. Thus, appearances of the phrases "in various embodiments," "in some embodiments," "in one embodiment," "some example embodiments," "one example embodiment," or "in an embodiment" in places throughout the specification are not necessarily all referring to the same embodiment. Furthermore, the particular features, structures or characteristics may be combined in any suitable manner in one or more embodiments.

Described herein are example embodiments of jewelry that can, when used as described herein, offer encouragement and/or inspiration to a user in need of encouragement and/or inspiration. In example embodiments, the jewelry is a ring, but the invention need not be so limited. In the illustrated embodiments, a ring is shown to describe certain advantages and benefits that can be realized with other jewelry, including necklaces, bracelets, keychains, etc.

The examples discussed herein are examples only and are provided to assist in the explanation of the apparatuses, devices, systems, and methods described herein. None of the features or components shown in the drawings or discussed below should be taken as mandatory for any specific implementation of any of these the apparatuses, devices, systems, or methods unless specifically designated as mandatory. For case of reading and clarity, certain components, modules, or methods may be described solely in connection with a specific figure. Any failure to specifically describe a combination or sub-combination of components should not be understood as an indication that any combination or sub-combination is not possible. Also, for any methods described, regardless of whether the method is described in conjunction with a flow diagram, it should be understood that unless otherwise specified or required by context, any explicit or implicit ordering of steps performed in the execution of a method does not imply that those steps must be performed in the order presented but instead may be performed in a different order or in parallel.

Referring to FIGS. 1-8, there is shown an embodiment of a jewelry device or apparatus, such as a ring 10 of the present disclosure. The ring 10 can have on overall size appropriate for wearing on a finger and can be provided in various sizes for various finger sizes. Ring 10 can have a base member, such as spinner support 12, onto which can be spinnably secured to a coupling member, such as spinning member 14. The spinner support 12 may be a unitary body or, as discussed below, may be made of more than one component. In an embodiment, spinner support 12 can be shaped as a ring for wearing on a finger, and, as well, be worn as a necklace when attached to a strung, thread, chain, or other necklace member. In general, interchangeable spinning members 14 can be secured to spinner supports 12 in the form of a necklace, bracelet, key chain, earrings, and combinations thereof. The spinner support 12 and spinning member 14 are discussed further below.

Figure 15:
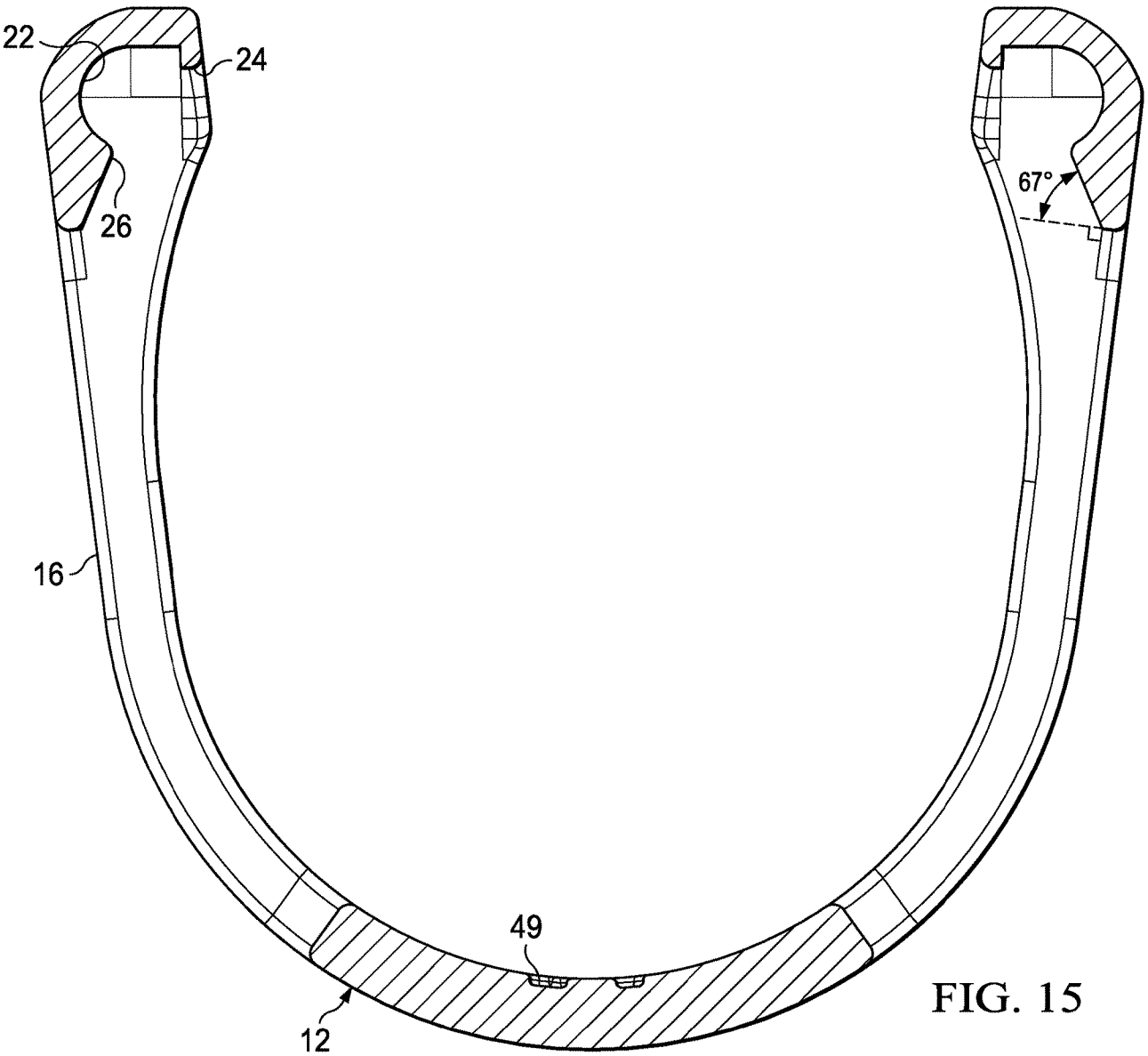
FIG. 15 depicts a cross-sectional view of the spinner support taken along line 15-15 in FIG. 13.

With reference to FIGS. 8-15, the spinner support 12 includes a disk member, such as support body 16, extending between two distal ends 18 of the spinner support 12. As shown in FIG. 1, when in the form of a ring to be worn on a finger, spinner support 12 can have a hippocrepiform shape, generally C-shape, or generally U-shape sized to fit a user's finger. The support body 16 includes a first prong and a second prong. The support body 16 defines a pair of oppositely disposed slots 20 that may be positioned near the distal ends 18 of spinner support 12. As shown in FIG. 15, the distal ends 18 of the spinner support 12 each include a recess or cavity 22 configured to receive a portion of the spinning member 14 as discussed further below. Each cavity 22 opens to one of the slots 20. The support body 16 may include openings 24 adjacent the distal ends 18 that extend into the slots 20 and the cavities 22. The openings 24 oppose each other and, when the spinning member 14 is coupled to the spinner support 12, are aligned with a longitudinal axis of the spinning member 14. In an embodiment, a width of the openings 24 may be smaller than a width of the slots 20 and/or a width of the cavities 22. The support body 16 also includes a lip 26 at the intersection of the slots 20 and the cavities 22. The lips 26 create a pinch point between the slots 20 and the cavities 22. As discussed further below, the lip 26 prevents the spinning member 14 from accidentally falling off the spinner support 12.

Figure 16:
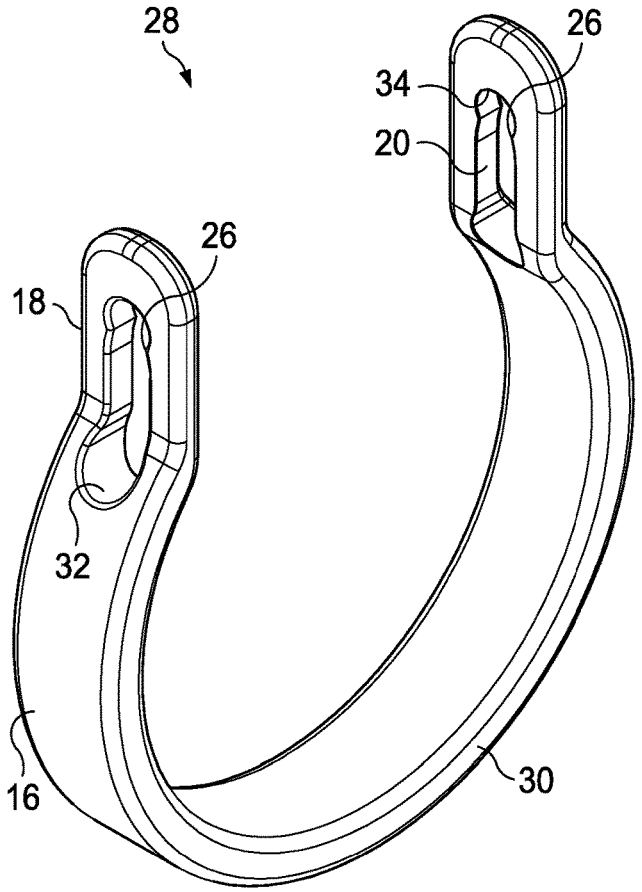
FIG. 16 depicts a perspective view of a spinner support according to an embodiment.

Referring now to FIGS. 16-22, where like numbers refer to like components depicted in FIGS. 1-15, various embodiments of a spinner support are shown. As shown in FIG. 16, in an embodiment, the support body 16 of spinner support 28 has a generally circular portion 30 from which the distal ends 18 extend. The distal ends 18 are generally parallel to each other. The slots 20 each include a first, proximal portion 32 and a second, distal portion 34. The width of the first, proximal portion 32 is larger than the width of the second, distal portion 34. The slots 20 each extend to the openings 24. A lip 26 separates the slots 20 and the openings 24. For example, the lip 26 may be at the intersection of the second, distal portion 34 of the slot 20 and the opening 24.

Figure 17:
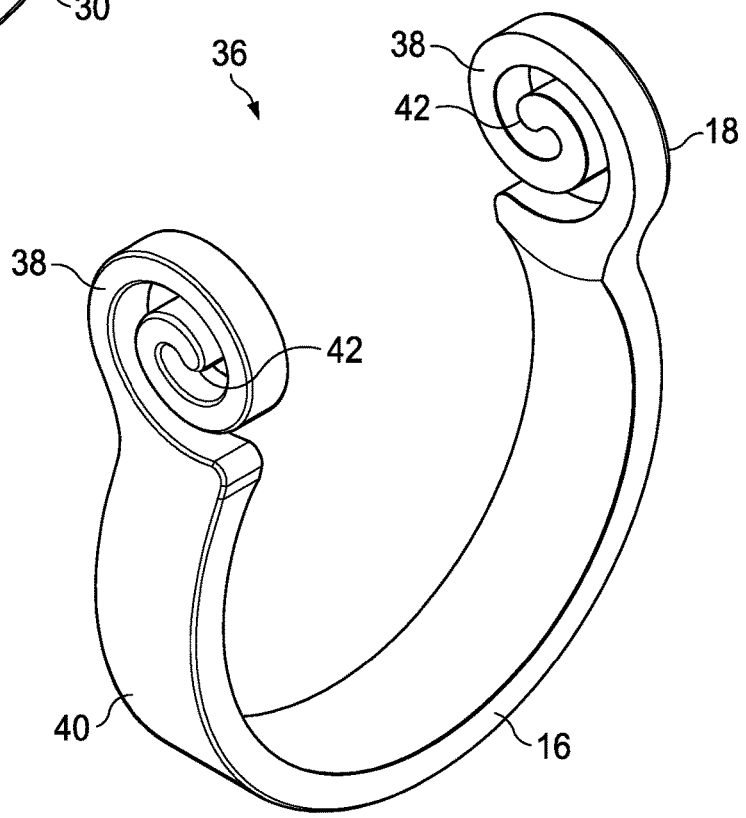
FIG. 17 depicts a perspective view of a spinner support according to an embodiment.
Figure 18:
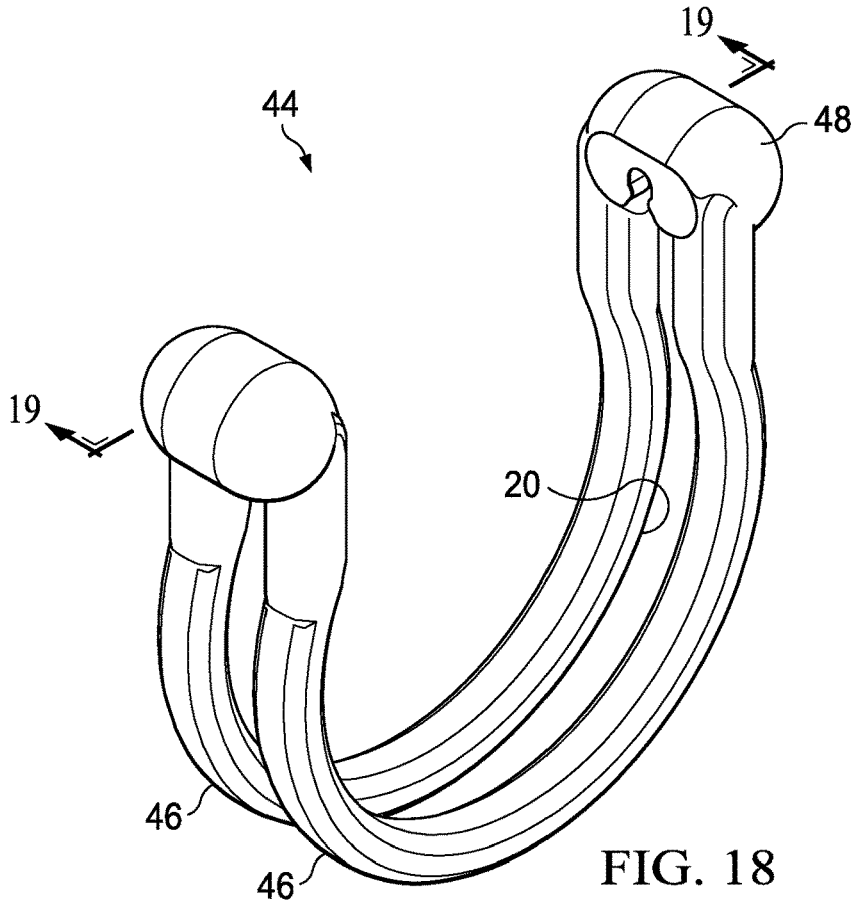
FIG. 18 depicts a perspective view of a spinner support according to an embodiment.
Figure 19:
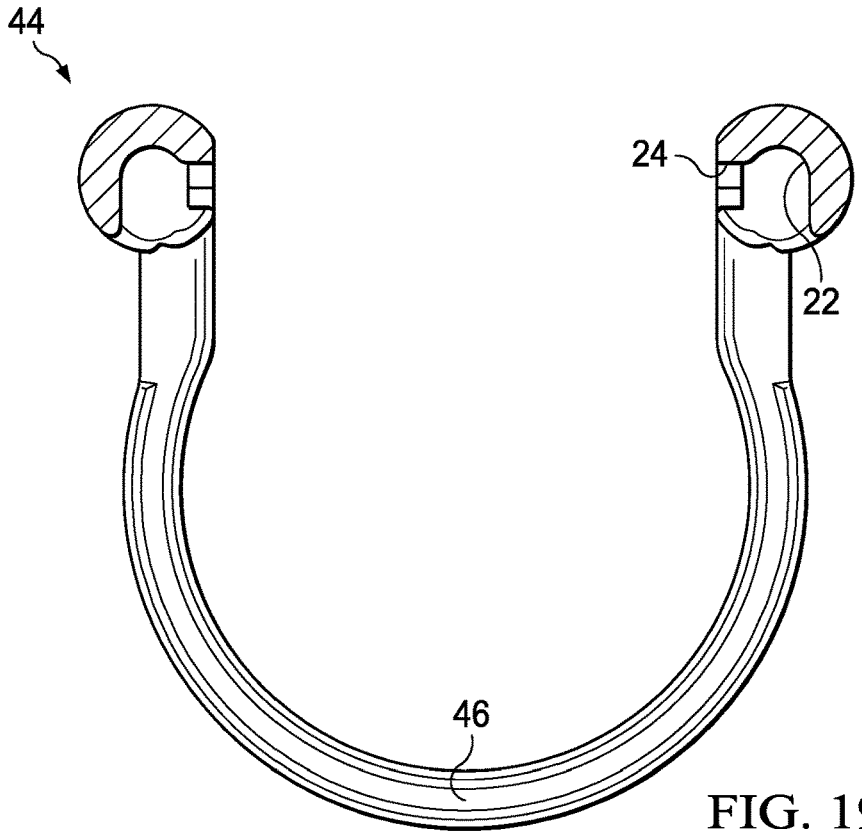
FIG. 19 depicts a cross-sectional view of the spinner support taken along line 19-19 in FIG. 18.

In another embodiment, as shown in FIG. 17, a spinner support 36 may include curvilinear or spiral slots 20. While the spirals are shown as being opposite in direction, the spirals may be in the same direction. Spiral portions 38 of the support body 16 extend from a generally circular portion 40 of the support body 16. A terminal end 42 of each spiral portion 38 of the support body 16 may have a larger thickness than the remainder of the spiral portion 38. This may act as a pinch point, as discussed further below.

In various embodiments, a spinner support may include one or more than one slot 20. For example, while the spinner supports 12, 28, 36 in FIGS. 8-17 include two slots 20, the spinner support 44 in FIGS. 18 and 19 include one slot 20. The slot 20 in the spinner support 44 extends unbroken between the distal ends 18. The support body 16 includes two spaced apart bands 46 that are joined at the distal ends 18 by bridge portions 48 of the support body 16. The bridge portions 48 include cavities 22 that open into the slot 20. The bridge portions 48 also include opposed openings 24 into the cavities 22. The openings 24 include lips 26 that act as a pinch point.

Figure 8:
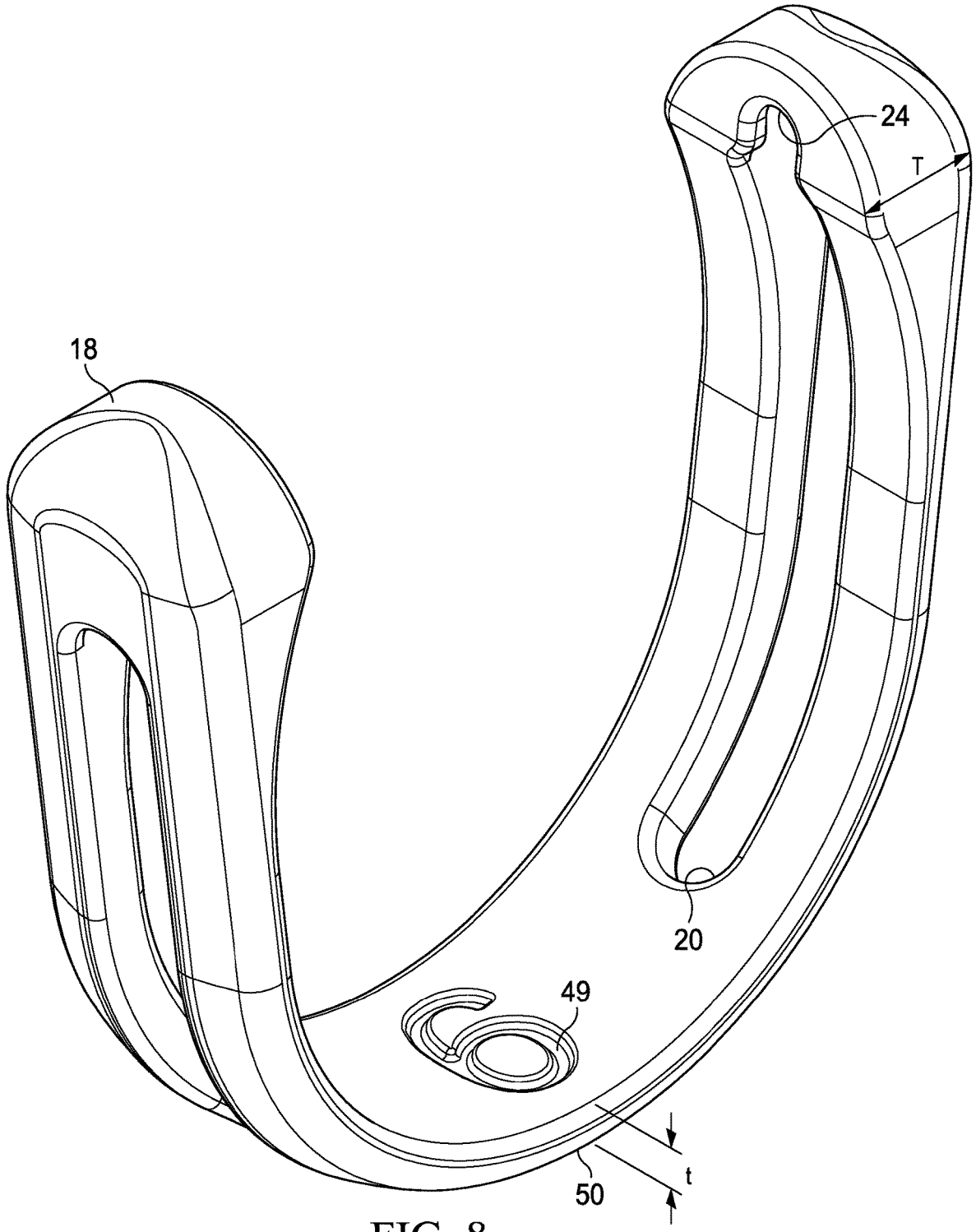
FIG. 8 depicts a perspective view of a spinner support according to an embodiment.
Figure 9:
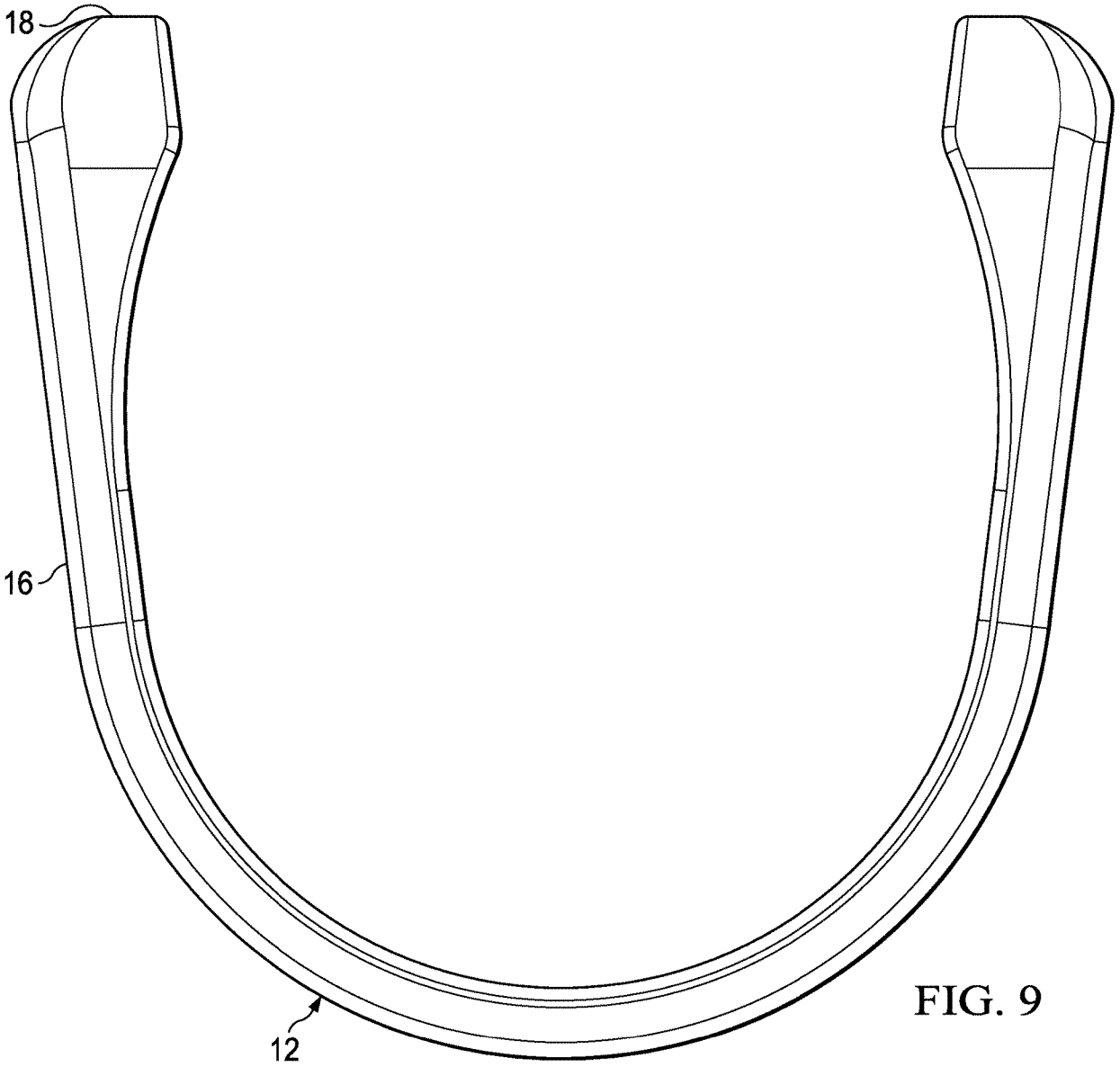
FIG. 9 depicts a front elevation view of the spinner support of FIG. 8.
Figure 10:
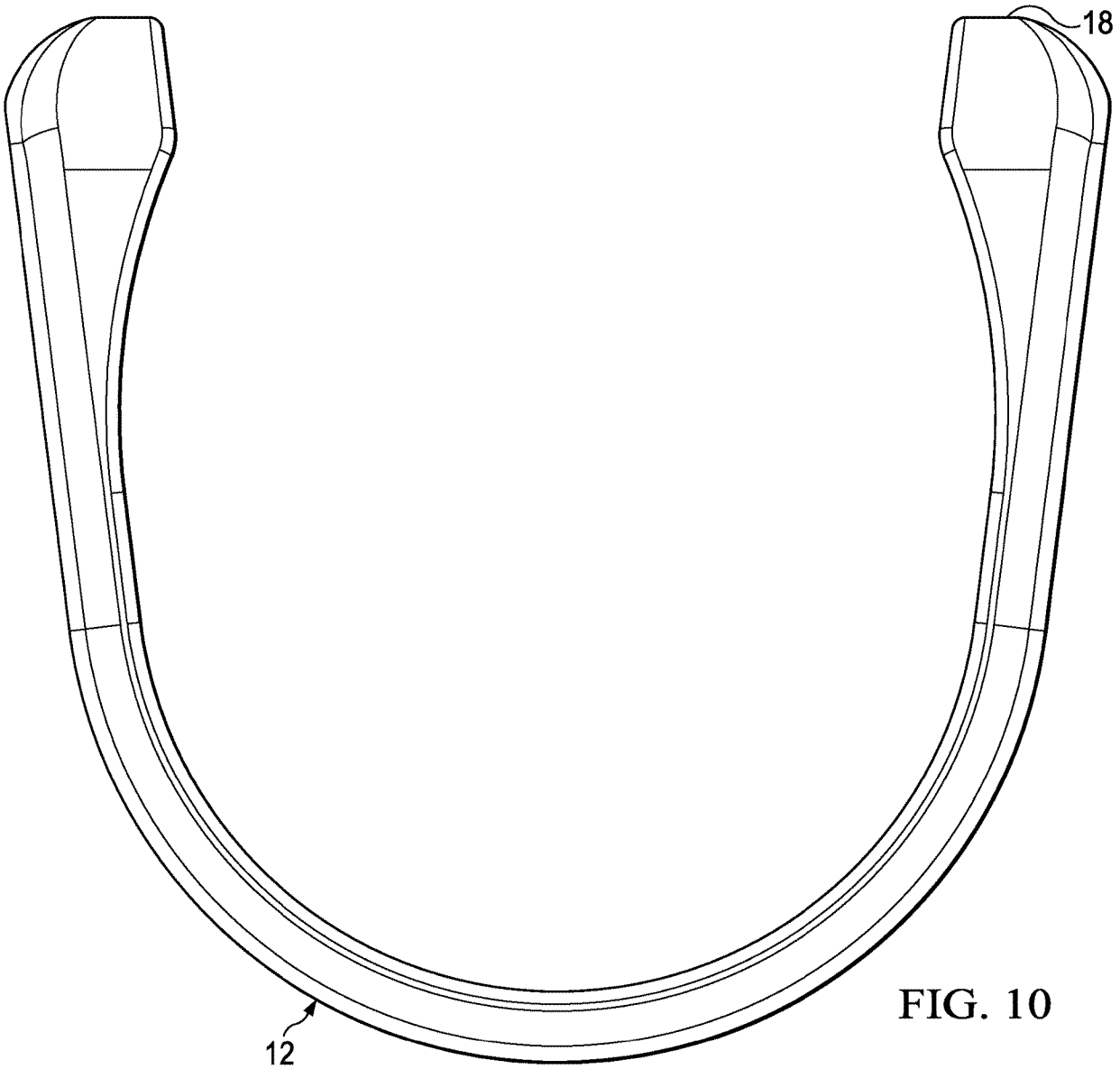
FIG. 10 depicts a rear elevation view of the spinner support of FIG. 8.
Figure 11:
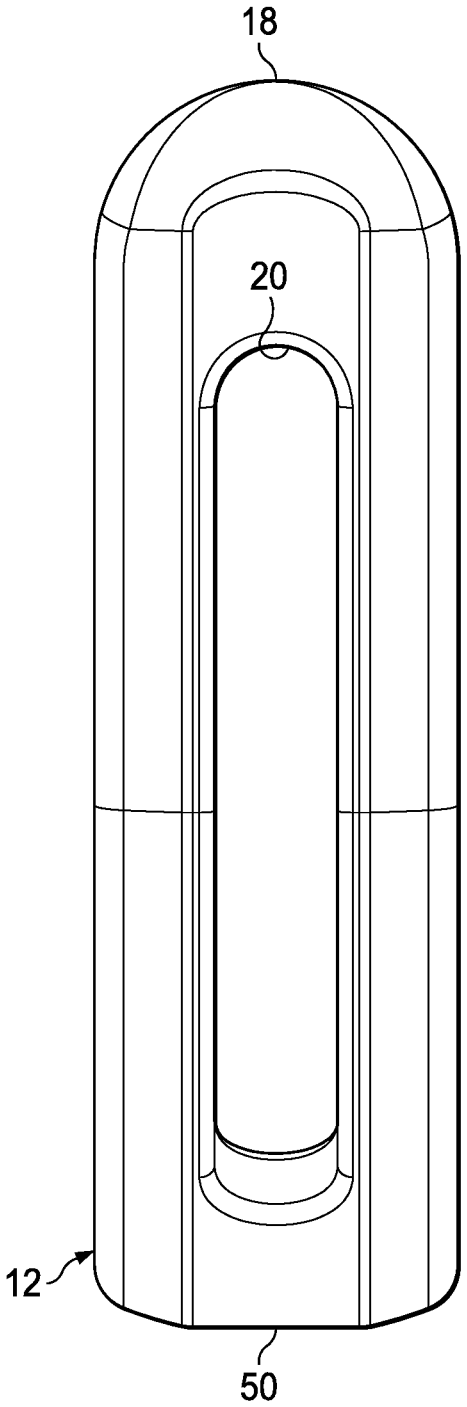
FIG. 11 depicts a right-side elevation view of the spinner support of FIG. 8.
Figure 12:
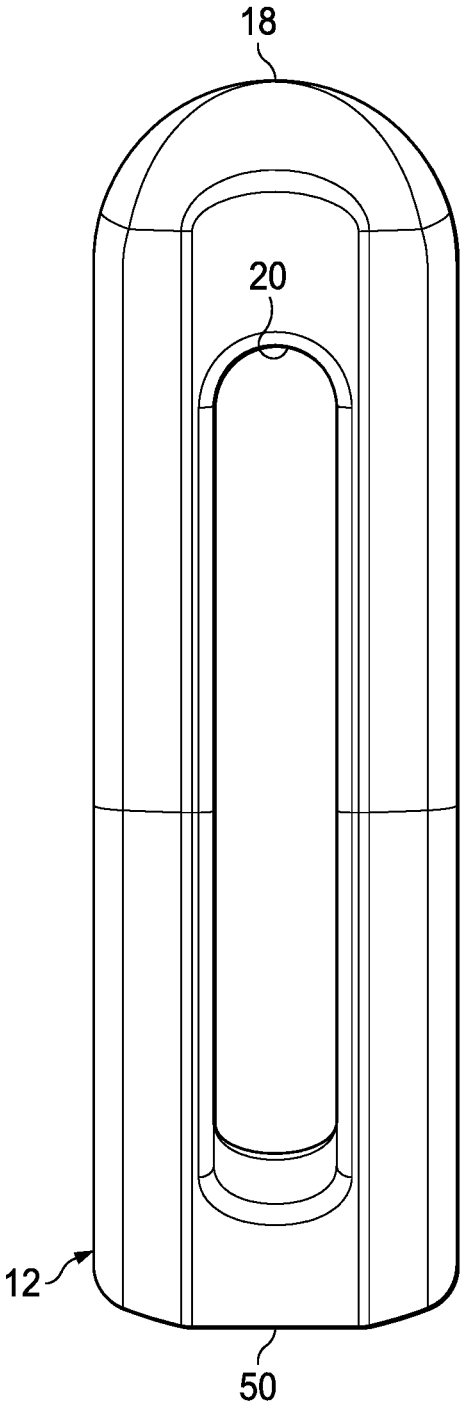
FIG. 12 depicts a left side elevation view of the spinner support of FIG. 8.
Figure 13:
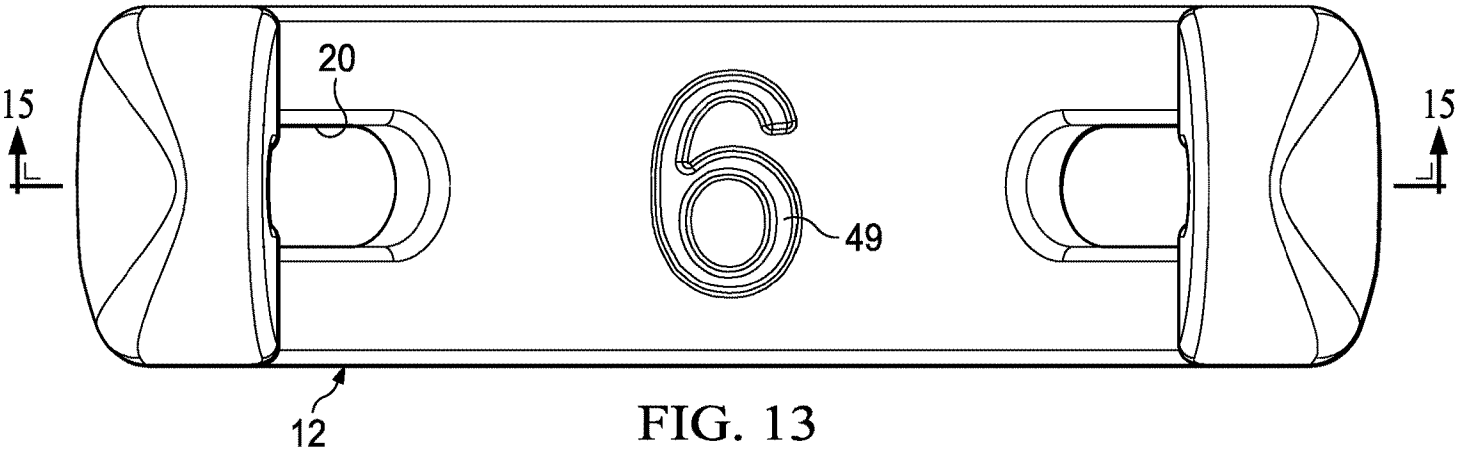
FIG. 13 depicts a top view of the spinner support of FIG. 8.
Figure 14:
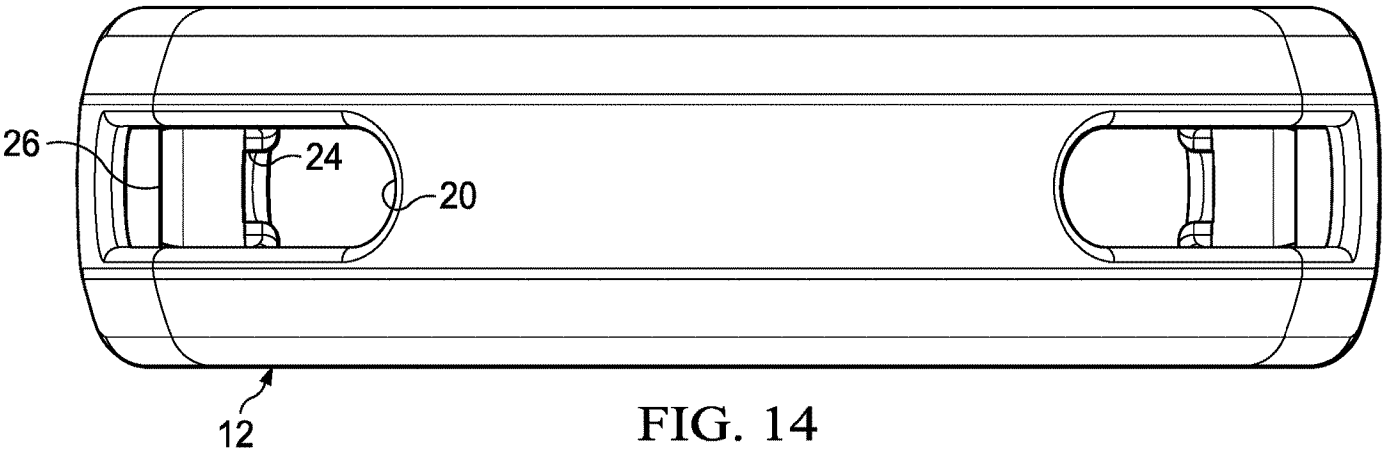
FIG. 14 depicts a bottom view of the spinner support of FIG. 8.
Figure 20:
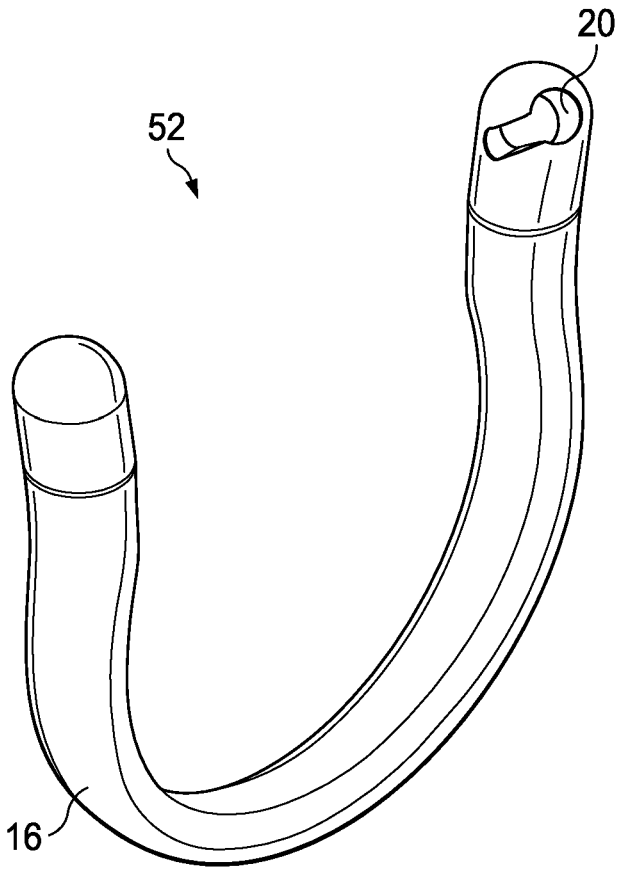
FIG. 20 depicts a perspective view of a spinner support according to an embodiment.
Figure 21:
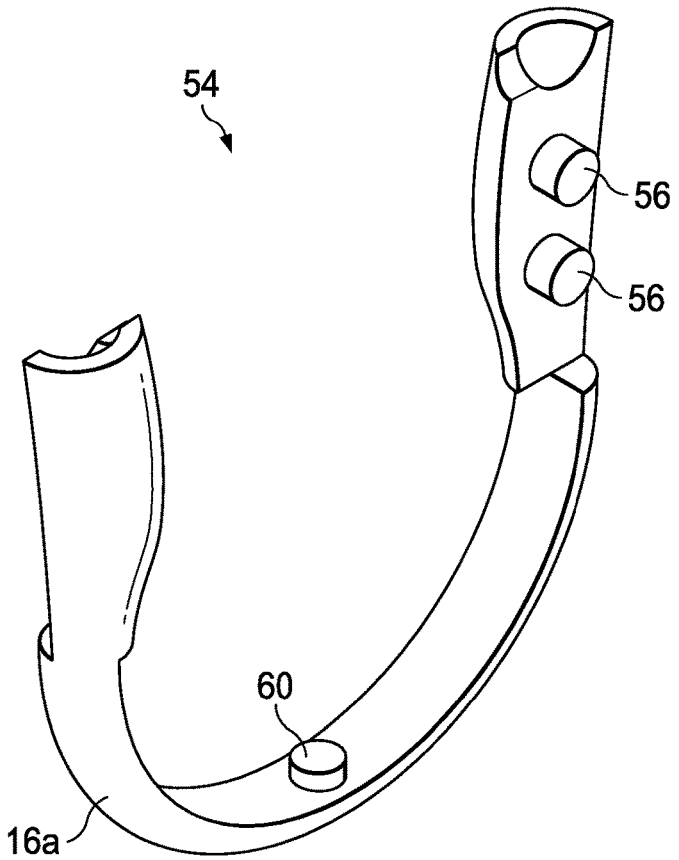
FIGS. 21 and 22 depict perspective views of portions of a spinner support according to an embodiment.
Figure 22:
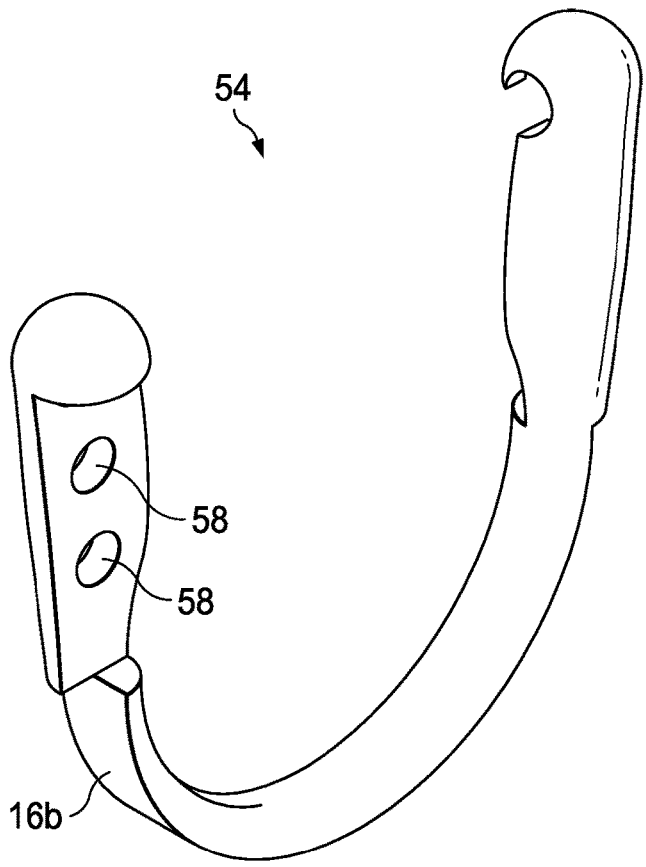
Figure 23:
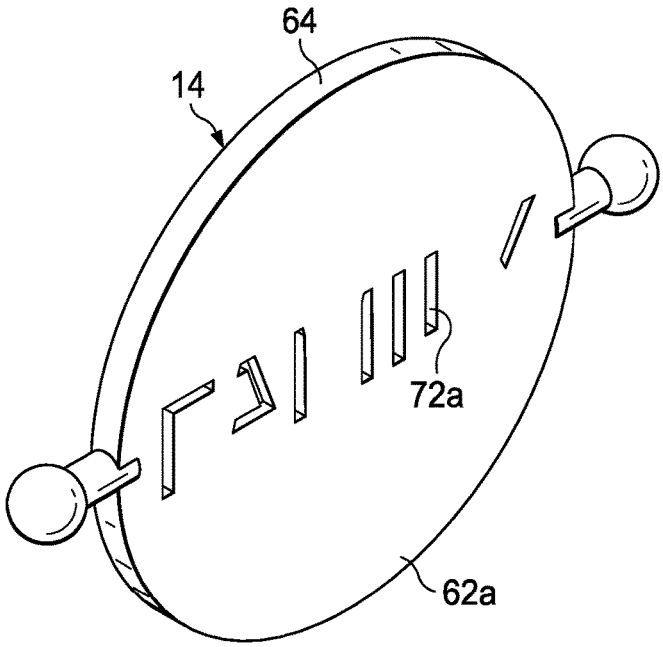
FIG. 23 depicts a perspective view of a spinning member according to an embodiment.

The dimensions of the support body 16 may vary. For example, as discussed above, the ring 10 can be provided in various sizes for various finger sizes. The distance between the slots 20 and/or cavities 22 may be constant over the various finger sizes allowing the same spinning member 14 to be used on spinner supports 12 of various sizes. The ring 10 may include indicia 49 showing, for example, the size of the ring. In another embodiment, as shown in FIG. 8, a thickness (T) of the distal ends 18 of spinner support 12 may be greater than a thickness (t) of the proximal end 50 of the spinner support 12. Additionally, the dimensions of the slots 20 may vary. As shown in FIGS. 8-15, the slots 20 of the spinner support 12 may extend along more than half of the length or more than two-thirds of the length of the support body 16. In comparison, as shown in FIG. 16, a majority of the length of the slots 20 extends through the distal ends 18 of the spinner support 12. As shown in FIG. 17, in another embodiment, the slots 20 may be confined to the distal ends 18 of the spinner support 12. In various embodiments, the spinner support may not include an elongated slot such as those shown in FIGS. 8-15. For example, as shown in FIG. 20, the spinner support 52 includes relatively short slots 20 opening into the cavities 22. Further, the width of the slots 20 may vary along the length of the slot 20. For example, in FIG. 16, the width of the proximal end of the slot 20 may be greater than the width of the distal end of the slot 20 (e.g., adjacent the lip 26).

In an embodiment, the spinner support may not include a slot. For example, with reference to FIGS. 21 and 22, a spinner support 54 includes a support body 16 with two interconnecting portions 16 *a* and 16 *b*. Portion 16 *a* of the spinner support 54 includes at least one projection 56 adjacent a distal end 18, and portion 16 *b* includes at least one corresponding aperture 58. The apertures 58 are sized to receive the projections 56. The portions 16 *a*, 16 *b* may also have an alignment feature. For example, portion 16 *a* may include an alignment projection 60 at a proximal end, which corresponds to an alignment aperture on an underside of the portion 16 *b*. With such a configuration, the portion 16 *b* may be placed on portion 16 *a* with the alignment projection 60 positioned in the alignment aperture, and the portions 16 *a*, 16 *b* may be twisted so that the apertures 58 receive the projections 56. When the portions 16 *a*, 16 *b* are joined, the distal ends 18 of both of the portions 16 *a*, 16 *b* together define cavities As shown in FIGS. 2-5 and 23-25, spinning member 14 may have two faces 62 *a*, 62 *b* spaced apart from each other. The two faces 62 *a*, 62 *b* may be generally parallel and flat so that, when the ring 10 is worn on a user's finger, the spinning member 14 can lay flat against the user's finger. The spinning member 14 includes a sidewall 64 extending between the faces 62 *a*, 62 *b*. In general, spinning member 14 can be any shape. In an embodiment, as illustrated, spinning member 14 can be generally circular or disc shaped. Spinning member 14 can be relatively thin and flat, similar to a coin. The shape can also be a square, rectangle, heart, star, hexagon, octagon, diamond, arrow, oval, crescent, or burst. Likewise, the shape can be the shape of a logo. The spinning member 14 may be a unitary body (e.g., FIGS. 23-25) or, as discussed below, may be made of more than one component.

Spinning member 14 can be secured to spinner support (e.g., spinner support 12) by a plurality, and as illustrated, two oppositely disposed projections 66 coaxially disposed on spinning member 14. The projections 66 can each have a central, longitudinal axis, and the axes of each can be coaxial and extend generally in directions 180 degrees apart about the sidewall 64 of spinning member 14 to define a spinning axis A. In an embodiment, spinning axis A bisects spinning member 14. Further, spinning axis A is generally perpendicular to a central axis of the spinner support 12 (e.g., the axis along which the ring will be moved when sliding onto a finger. Each projection 66 may include arm portions 68 and generally enlarged, e.g., ball-shaped, distal ends 70. Cavities 22 may be sized to retain the distal ends 70. Enclosing the ends 70 of the spinning member 14 may prevent the spinning member 14 from being caught on, e.g., clothes and accidentally pulled out of the spinner support 12.

In various embodiment, lips 26 may be sized to provide a pinch point between the openings 24 or cavities 22 and the slots 20. For example, in an embodiment, the lip 26 may extend outwardly at a 67-degree angle to form the bottom of the cavity 22. There may be an overlap of around 0.35 mm between the lip 26 and the end of the distal end 70 when it is in the cavity 22, which creates the pinch point. There may also be, for example, a 0.25 tolerance between the cavity 22 and the size of the distal end 70 that allows ball to spin freely. Thus, to move between the uncoupled and coupled positions, the projection 66 must pass over the lips 26 (i.e., past the pinch point). Consequently, a force must be applied to the projections 66 to move over the lips 26; the force is greater than, for example, the force required to overcome any friction between the projections 66 and the support body 16.

The projections 66 of spinning member 14 can be placed, snapped, clipped, or otherwise securely secured to or through the spinner support 12. The projections 66 may move from an uncoupled position to a coupled position, in which the projections 66 are retained by the support body 16. For example, the projections 66 may extend through the slot(s) 20 and/or openings 24 when present. Referring to FIGS. 1-7, in an embodiment, the spinning member 14 may be angled so that one projection 66 is inserted into one of the slots 20, after which the other projection 66 may be moved into the opposing slot 20. Once both projections 66 are in the respective slots 20, the spinning member 14 may be moved upwards so that the distal ends 70 pass the lips 26. In this coupled position, the arms 68 extend through the openings 24, and the distal ends 70 are positioned in cavities 22. To move the projections 66 into an uncoupled position, the projections 66 must be forced over the lips 26 and may be removed from the slots 20.

Figure 26:
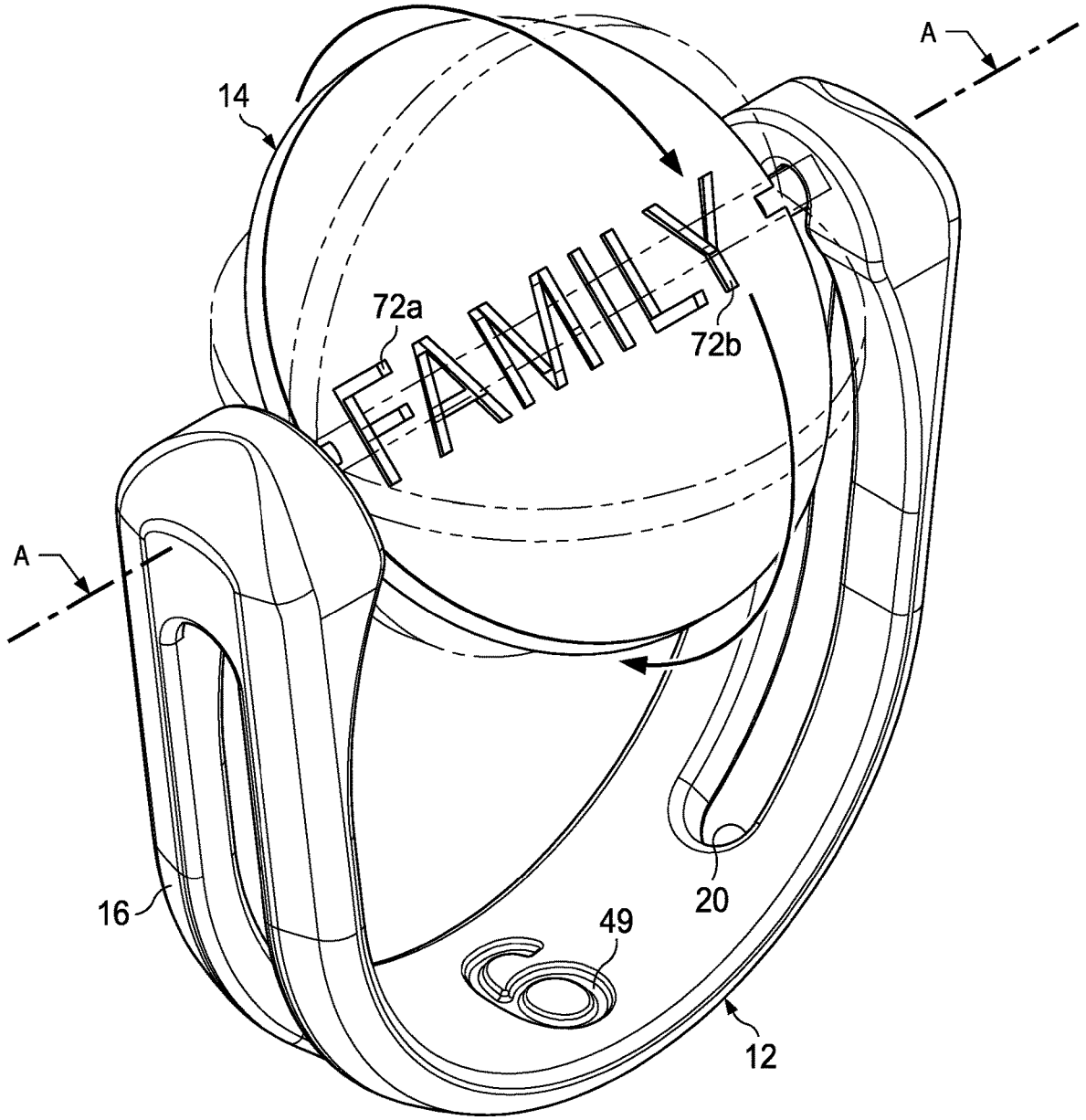
FIG. 26 depicts a perspective view of a jewelry device according to an embodiment showing the spinning member spinning around axis A.

Due to the variety of configurations of the support body 16, there are numerous ways by which the spinning member 14 may be coupled to the spinner support 12. Referring to FIG. 16, the projections 66 may be positioned through a widened end of a slot 20 and then translated past the pinch point (i.e., past lips 26) into the coupled position. In an embodiment, the distal ends 70 of the projections 66 may be sized to fit in the cavities 22 of the support body 16. Referring to FIG. 17, the arms 68 may be slid through open ends of the spiral slots 20 with the distal ends 70 extending outside the slots 20. The arms 68 may be rotated through the spiral slots 20 and past the lip 26 into the closed end of the spiral slots 20 (i.e., into a coupled position). Further slot and projection configurations can be realized as is known in the art to permit installation and removal of spinning member 14 onto spinner support 12. It is understood that, in this manner, spinning member 14 is removable, and various alternative spinning members can be interchangeable with a spinner support 12. Further, it understood that once spinning member 14 is secured onto spinner support 12, spinning member 14 can spin freely about the axis A, as shown in FIG. 26.

Spinning member 14 can have indicia 72 on one or both of the faces 62 *a*, 62 *b*. The indicia 72 may include partial or full letters and/or partial and full words. Referring to FIGS. 23-26, in an embodiment, indicia 72 *a* on a first face 62 *a* of spinning member 14 depicts a partial word, and indicia 72 *b* on an opposite second face 62 *b* of spinning member 14 depicts a complementary partial portion of the word partially depicted on the first face 62 *a*. When spun about the axis A, a full, readable word appears to the eye of a user. For example, the combined indicia 72 *a*, 72 *b* appears as the word "FAMILY" in FIG. 26. In an embodiment, indicia 72 *a* on a first face 62 *a* of spinning member 14 comprises half of a letter or word and the indicia 72 *b* on the second face 62 *b* of spinning member 14 comprises the other half of the letter or word. In another embodiment, indicia 72 depicts a full, readable, word. In an embodiment, indicia 72 depicts a partial word so designed on one face 62 *a*, 62 *b* of spinning member 14, such that if spinning member 14 is spun, a full, readable word appears to the eye of a user. In an embodiment spinning member 14 can have indicia 72 thereon such that a different word or phrase is rendered when spun one direction versus the other.

Figure 24:
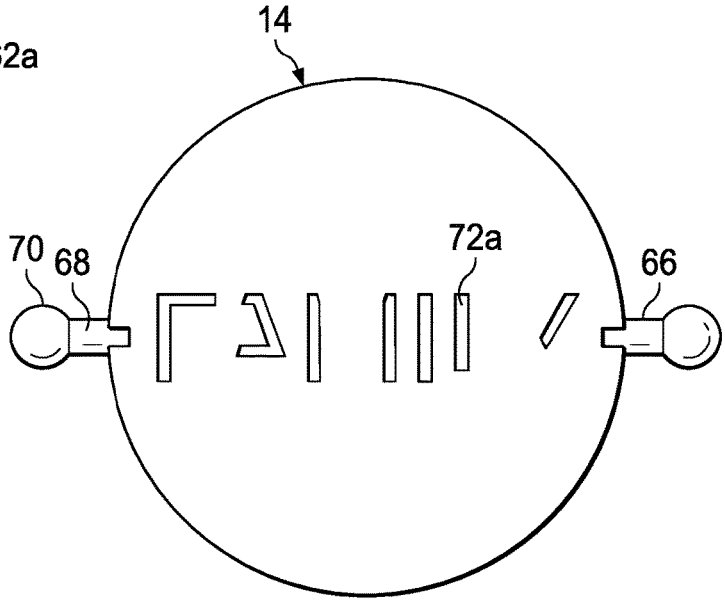
FIG. 24 depicts a top view of the spinning member of FIG. 23.
Figure 25:
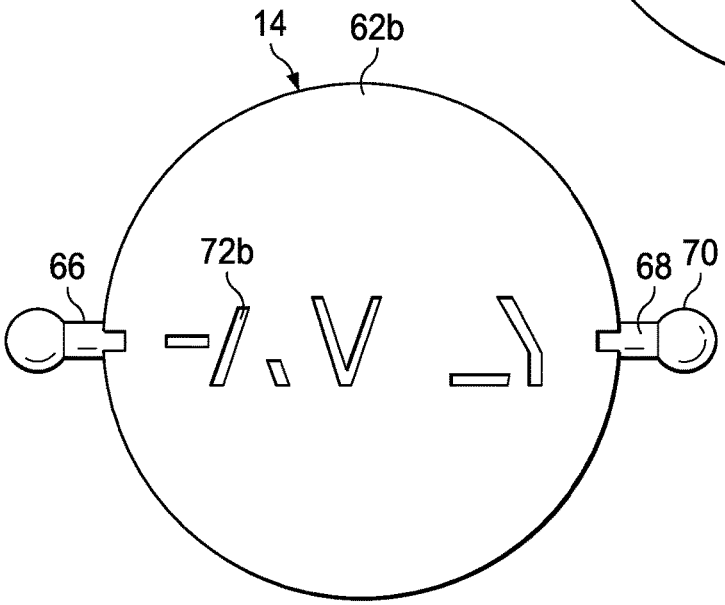
FIG. 25 depicts a bottom view of the spinning member of FIG. 23.

When worn as a ring, one of the two opposing faces 62 *a*, 62 *b* of spinning member 14 can be visible to a wearer (e.g., FIG. 24 or FIG. 25). When desired, a user can remove the jewelry and "fidget" with the spinning member 14 by spinning it about axis A (e.g., FIG. 26). Additionally, the user may remove one of a plurality of spinning members 14 and replace it with another of a plurality of spinning members 14. Removal and replacement of spinning member 14 can effect a change in color, or other appearance of the jewelry, such as ring 10, as well as a change in the word or phrase rendered upon spinning of spinning member 14.

The letters, words, or phrases that appear to a user when the spinning member 14 is spun about axis A can include inspiring or encouraging words or phrases, such as: dream big, change, be kind, I am, faith, shine, be happy, fierce, worth it, good luck, love, I love you, most, create, grit, let go, focus, half full, let go, free hugs, focus, brave, family, hope, grace, joy, today, trust, worthy, be still, you got this, conquer, namaste, amazing, courage, believe, inspired, fearless, grateful, no regrets, enough, patience, breathe, balance, adventure, be present, compassion, confident, determined, strength, warrior, passion, purpose, resilient, and the like. A kit may include one or more spinner supports and one or more spinning members, where the spinning members include different words.

Figure 27:
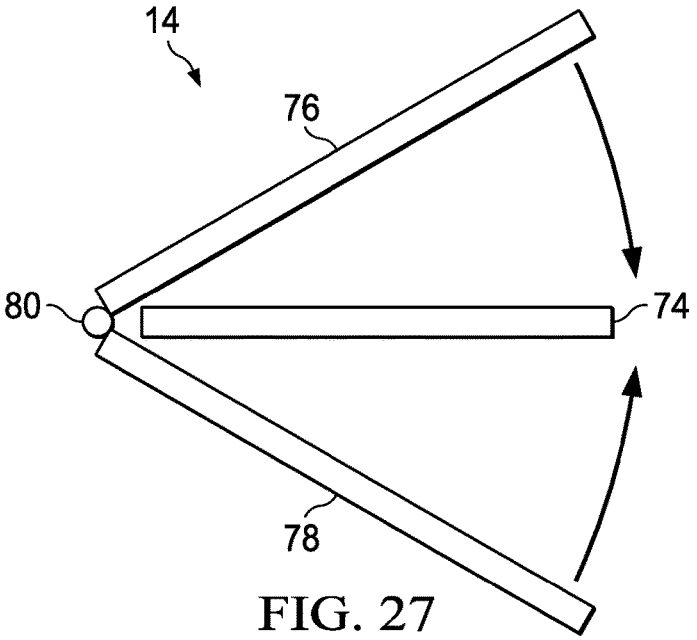
FIG. 27 depicts a spinning member according to an embodiment.
Figure 28:
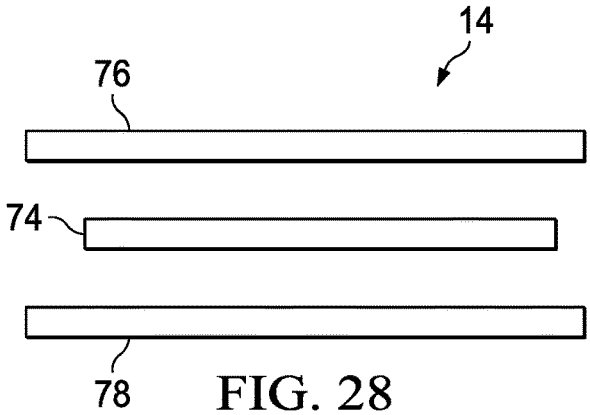
FIG. 28 depicts a spinning member according to an embodiment.
Figure 29:
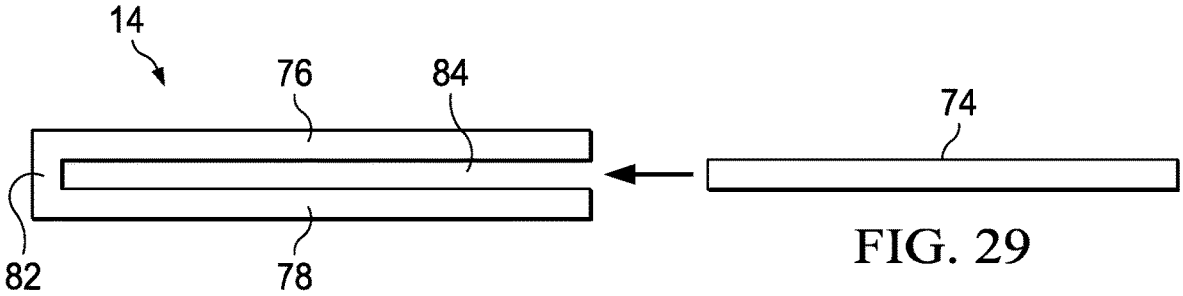
FIG. 29 depicts a spinning member according to an embodiment.

As shown in FIGS. 27-29, spinning member 14 can have multiple parts, including a part devoid of indicia and secured so as to be un-detachable from the spinner support 12, and a separate indicia-bearing element 74 can be secured to spinning member. By way of example, as shown in FIG. 27, spinning member 14 can have two opposing, ring-shaped members 76, 78, between which an indicia-bearing element 74 can be inserted and secured by closing ring-shaped members 76 and 78 about hinge member 80, such that indicia-bearing element is secured between and visible through ring-shaped members 76 and 78. In a similar manner, as shown in FIG. 28, ring shaped members 76 and 78 can be discrete parts that can be secured such as by screwing, pressing, snapping, or otherwise closing to trap indicia-bearing member 36 there between. In another embodiment, spinning member 14 can be generally hollow and open faced, such that an indicia-bearing insert 36 can be placed, snapped, slid, or otherwise inserted into the hollow portion and visible from each face of the spinning element. By way of example, as shown in FIG. 29, in an embodiment, spinning member 14 can have rigidly connected ring-shaped members 76, 78 connected by bridge member 82, thereby defining a slot 84 into which an indicia-bearing element 74 can be inserted in the direction shown by the arrow. In each of the above-mentioned embodiments, in general, an indicia-bearing element can be inserted into or between clasp members that can securely hold the indicia-bearing element in place and permit easy replacement of a different indicia-bearing element.

Spinner support 12 or spinning member 14 can be made of materials suitable for wearable jewelry, including metal, such as stainless steel, gold, or silver, plastic, ceramic, wood, or combinations thereof. The material and design of the spinner support 12 and spinning member 14 should be such that, when the spinning member 14 is being spun, the spinning member 14 does not wobble or move side-to-side. The color of the spinner support 12 and/or spinning member 14 may vary. For example, the color may be silver, gold, rose gold, or a combination thereof.

In an embodiment, a plurality of spinning members 14 can each have different indicia 72 on the faces thereof, such that when spun, each of the plurality of spinning members 14 can render a different full, readable word to the eye of a user. In an embodiment, each of a plurality of spinning members 14 can be interchangeable with any of a plurality of spinner supports 12. In an embodiment, spinner supports 12 can be supplied in a range of sizes to fit a range of finger sizes.

Figure 30:
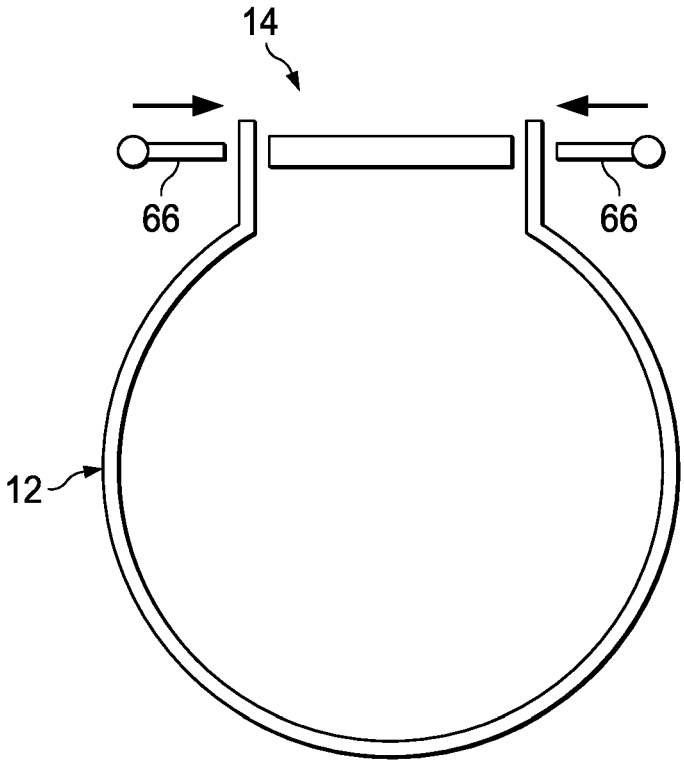
FIG. 30 depicts a jewelry device according to an embodiment.
Figure 31:
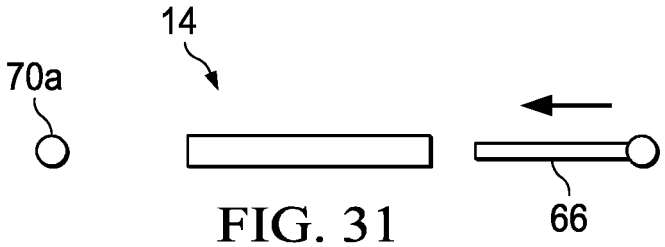
FIG. 31 depicts a spinning member according to an embodiment.
Figure 32:
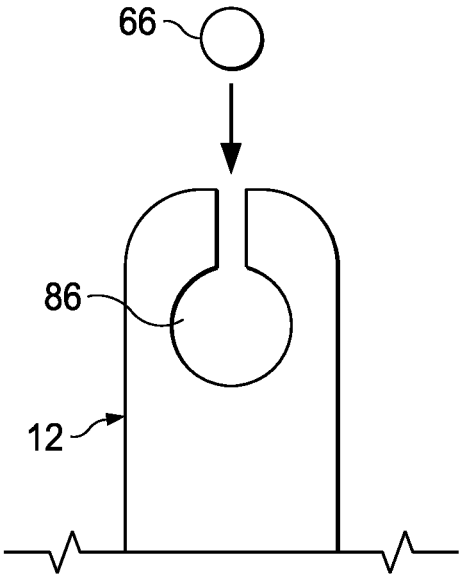
FIG. 32 depicts a jewelry device according to an embodiment.
Figure 33:
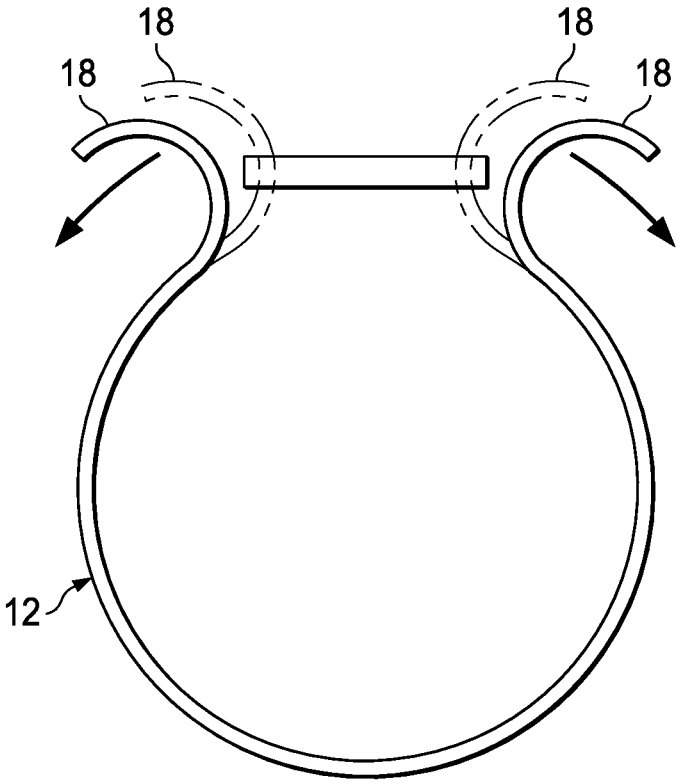
FIG. 33 depicts the jewelry device of FIG. 32 showing the flexibility of the spinner support.

Other connection configurations for securing spinning member 14 to spinner support 12 are contemplated. For example, the projections 66 can be flexible, elastic, or otherwise pliable so as to be stretched and secured to the opposed distal ends of spinner support 12. In an embodiment, as shown in FIG. 30, projections 66 can be discrete elements that are inserted, screwed, pressed, or otherwise connected in the direction shown by arrows to spinning element 14 through channels in spinner support 12. In a similar manner, as shown in FIG. 31, projections 66 can be configured as a single member that is inserted in the direction shown by the arrow through an opening in spinning member 14. Projection 66 can be secured to, such as by screwing or pressing into ball shaped end 70 *a* and thereafter secured to spinner support 12 (not shown). In an embodiment, as shown in FIG. 32, openings 86 can have a portion having a width dimension that is less than the diameter of projection 66, such that projection 66 can be translated in the direction of the arrow and pressed through the reduced width portion to a portion having a width dimension greater than the diameter of the projection 66. In an embodiment, as shown in FIG. 33, spinner support 12 can be a spring, such that distal ends 18 thereof can be separated apart in the direction of the arrows a sufficient amount to insert spinning member 14 and projections 66 between the distal ends 18. The distal ends 18 can then be released and spring back into a rest position in which projections 66 are secured to openings 86.

In an embodiment the separate indicia-bearing element can be in the form of a sticker, a magnetic film, a self-adhering thin film, or the like. In an embodiment, the spinning member 14 can be screwed onto the spinner support. In an embodiment, an indicia-bearing element can be screwed onto spinning member 14. In an embodiment, projections 66 can be generally straight, cylindrically shaped rods that extend through openings 86, or holes in place of slots, and a screw-on ball can screw onto the end of each rod projection 66. In an embodiment, projections 66 can be open-ended such that a spinning member 14 can be "clicked onto" or otherwise pressed into place from the top such that the ring need not be removed from a user's finger to switch out a spinning member. Similarly, in a manner similar to that described above with respect to FIG. 32, the openings 86 can have side openings such that a spinning member 14 can be "clicked onto" or otherwise pressed into place from the side near the top such that the ring need not be removed from a user's finger to switch out a spinning member. In an embodiment, once spinning member is placed into openings 86, a portion of spinner support 12 at the distal ends can be rotated such that the open end of the opening 86 is effectively closed.

Spinner support 12 can be "one size fits all" by being spring biased such that the distal ends having openings 86 therein can be, when relaxed relatively close together. Projections 66 on spinning member 14 can have sufficient length such that upon being placed in openings 86 as described above, the length of projections 66 permits some play of the slots along the length of projections 66, such that the distal ends of spinner support 12 can be biased outwardly, increasing the diameter of the ring shape, and conforming to the circumference of a user's finger.

Figure 34:
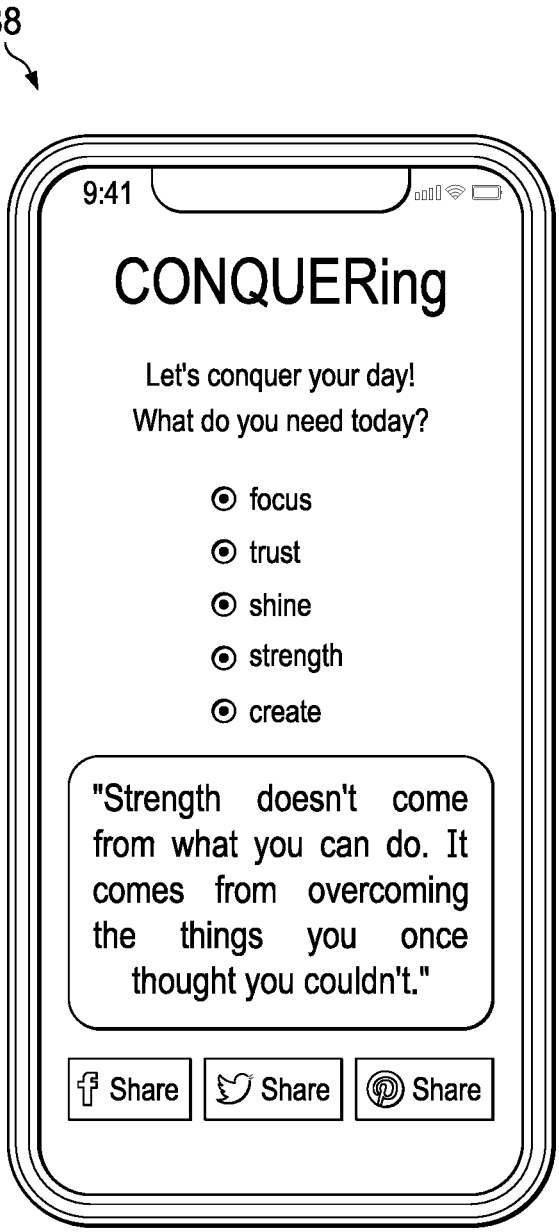
FIG. 34 depicts a screenshot of an app utilized with a jewelry device of the present disclosure.

Referring now to FIG. 34, in an embodiment, a device, such as a smartphone 88, can have memory and executable instructions to provide a menu of various options by which the smartphone 88 can be utilized to increase the functional benefits of ring 10. FIG. 34 shows a representative screenshot of a smartphone app configured.

In an embodiment the smartphone 88 can utilize one or more on-board or web-accessed applications that provide more functionality to the ring 10. For example, in an embodiment system and method, a user can secure a spinning member 14 onto a spinner support 12, spin the spinning member 14 to visualize the word or phrase rendered readable when spun, and then use the smartphone 88 app to receive an inspirational message related to the word or phrase rendered readable. In an embodiment, the app on smartphone 88 can display a list of possible options based on the number and kind of spinning members 14 the user has. The user can select the spinning member 14 utilized at a given time, and the app can serve up an inspirational message. In an embodiment, the inspirational message can be shared on social media. In an embodiment, the app on smartphone 88 can trigger a message to the user if the user has not accessed the app in a given time period. In an embodiment, the user can input to the app inspiring quotes that can be utilized later by the app. In an embodiment, the user can earn discounts on the cost of future spinning members 14 by sharing on social media.

For all of the smartphone apps for which a ring 10 can be utilized, it is recognized that all known app-writing, testing, and implementation measures as is known in the art can be utilized. Thus, an app as described herein, is intended to cover the application, the screen displays, the software, the web links, and any and all other of known app-implementation measures as is known to those of skill in the art. For example, a push notification protocol may be included.

The foregoing description of embodiments and examples has been presented for purposes of illustration and description. It is not intended to be exhaustive or limiting to the forms described. Numerous modifications are possible in light of the above teachings. Some of those modifications have been discussed, and others will be understood by those skilled in the art. The embodiments were chosen and described in order to best illustrate principles of various embodiments as are suited to particular uses contemplated. The scope is, of course, not limited to the examples set forth herein, but can be employed in any number of applications and equivalent devices by those of ordinary skill in the art. Rather it is hereby intended the scope of the invention to be defined by the claims appended hereto.

What is claimed is:

1. A jewelry apparatus, the jewelry apparatus comprising:

a. a base member having a hippocrepiform configuration, the base member having a first prong and a second prong, wherein the first prong defines a first recess, and the second prong defines a second recess, wherein at least one of the first prong or second prong defines a first slot; and b. a coupling member operably configured for attachment to the base member, the coupling member comprising;

i. a disk member;

ii. a first projection extending from the disk member operably configured for attachment to the first prong; and iii. a second projection extending from the disk member operably configured for attachment to the second prong;

wherein the disk member is movably coupled to the base member and the coupling member is configured to rotate; and wherein the first projection and second projection each include an arm portion and an enlarged distal end and wherein the enlarged distal end of the first projection is positioned within the first recess and wherein the enlarged distal end of the second projection is positioned within the second recess when the coupling member is coupled to the base member.

2. The apparatus of claim 1, wherein the other of the first prong or second prong defines a second slot.

3. The apparatus of claim 1, wherein the first slot includes a first portion having a first width and a second portion having a second width, the second width being smaller than the first width.

4. The apparatus of claim 1, wherein one of the first recess or the second recess opens into the first slot.

5. The apparatus of claim 4, further comprising a first lip between the first slot and one of the first recess or the second recess.

6. The apparatus of claim 1, wherein the first projection or the second projection is configured to produce a tactile indication when inserted into or removed from the first prong or second prong.

7. A jewelry apparatus, the jewelry apparatus comprising:

a. a base member having a hippocrepiform configuration, the base member having a first prong and a second prong, wherein the first prong defines a first recess, and the second prong defines a second recess; and b. a coupling member operably configured for attachment to the base member, the coupling member comprising;

i. a body member;

ii. a first projection extending from the body member operably configured for attachment to the first prong; and iii. a second projection extending from the body member operably configured for attachment to the second prong;

wherein the body member is movably coupled to the base member and the coupling member is configured to rotate; and wherein the first projection and second projection each include an arm portion and an enlarged distal end and wherein the enlarged distal end of the first projection is positioned within the first recess and wherein the enlarged distal end of the second projection is positioned within the second recess when the coupling member is coupled to the base member.

8. The apparatus of claim 7, wherein at least one of the first prong or second prong defines a first slot and wherein one of the first recess or the second recess opens into the first slot.

9. The apparatus of claim 8, further comprising a first lip between the first slot and one of the first recess or the second recess.

10. The apparatus of claim 7, wherein the first projection or the second projection is configured to produce a tactile indication when inserted into or removed from the first prong or second prong.

11. The apparatus of claim 7, wherein the body member is circular, or disc shaped.

12. A jewelry apparatus, the jewelry apparatus comprising:

a. a base member having a hippocrepiform configuration, the base member defining a first recess, a second recess, and a first slot, wherein one of the first recess or the second recess opens into the first slot; and b. a coupling member operably configured for attachment to the base member, the coupling member comprising;

i. a body member;

ii. a first projection extending from the body member operably configured for attachment to one of the first recess or second recess; and iii. a second projection extending from the body member operably configured for attachment to the other of the first recess or second recess;

wherein the coupling member is configured to rotate; and wherein the first projection and second projection each include an arm portion and an enlarged distal end and wherein the enlarged distal end of the first projection is positioned within the first recess and wherein the enlarged distal end of the second projection is positioned within the second recess when the coupling member is coupled to the base member.

13. The apparatus of claim 12, further comprising a first lip between the first slot and one of the first recess or the second recess.

14. The apparatus of claim 12, wherein the body member is circular, or disc shaped.

* * * * *